US010923009B2

(12) United States Patent
Lee et al.

(10) Patent No.: US 10,923,009 B2
(45) Date of Patent: Feb. 16, 2021

(54) IMAGE COMPENSATOR AND METHOD FOR DRIVING DISPLAY DEVICE

(71) Applicant: Samsung Display Co., Ltd., Yongin-si (KR)

(72) Inventors: Jun Gyu Lee, Yongin-si (KR); Byung Ki Chun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 19 days.

(21) Appl. No.: 16/523,775

(22) Filed: Jul. 26, 2019

(65) Prior Publication Data

US 2020/0074906 A1 Mar. 5, 2020

(30) Foreign Application Priority Data

Aug. 31, 2018 (KR) ..... 10-2018-0103992

(51) Int. Cl.
*G09G 3/20* (2006.01)

(52) U.S. Cl.
CPC ..... *G09G 3/20* (2013.01); *G09G 2320/106* (2013.01); *G09G 2370/08* (2013.01)

(58) Field of Classification Search
CPC . G09G 3/20; G09G 2320/08; G09G 2320/106
USPC ..... 345/204, 690, 691
See application file for complete search history.

(56) References Cited

U.S. PATENT DOCUMENTS 8,422,800 B2 * 4/2013 Hsu ..... H04N 19/182 382/232
2005/0204313 A1 * 9/2005 Enoki ..... G09G 3/28 715/867
2012/0236040 A1 9/2012 Eom et al.
2014/0307964 A1 10/2014 Kim et al.
2016/0189336 A1 6/2016 Lee et al.
(Continued)

FOREIGN PATENT DOCUMENTS

KR 10-2014-0122605 A 10/2014
KR 10-2016-0129985 A 11/2016
(Continued)

OTHER PUBLICATIONS

EPO Extended Search Report dated Jan. 23, 2020, for corresponding European Patent Application No. 19194765.4 (9 pages).

*Primary Examiner* — Calvin C Ma

(74) *Attorney, Agent, or Firm* — Lewis Roca Rothgerber Christie LLP

(57) ABSTRACT

An image compensator includes: a shift path updater for updating a first preliminary shift direction of a fixed image included in an image in a preset first period according a first shift scenario, and updating a second preliminary shift direction of the fixed image in a preset second period according a second shift scenario; a shift direction determiner for correcting the first preliminary shift direction and the second preliminary shift direction respectively to a first target shift direction and a second target shift direction, based on a result obtained by comparing the first preliminary shift direction and the second preliminary shift direction; a first shift controller for performing a first image shift, based on the first target shift direction; and a second shift controller for performing a second image shift, based on the second target shift direction.

26 Claims, 16 Drawing Sheets

(56) References Cited

U.S. PATENT DOCUMENTS

| | | | |
|---|---|---|---|
| 2016/0217770 | A1 | 7/2016 | Kang et al. |
| 2016/0321973 | A1 | 11/2016 | Chun et al. |
| 2016/0329008 | A1 | 11/2016 | Chun et al. |

FOREIGN PATENT DOCUMENTS

| | | | |
|---|---|---|---|
| KR | 10-2016-0132170 | | 11/2016 |
| KR | 10-2020-0026421 | A | 3/2020 |

* cited by examiner

LSA = 6

IMAGE COMPENSATOR AND METHOD FOR DRIVING DISPLAY DEVICE

CROSS-REFERENCE TO RELATED APPLICATION

The present application claims priority to and the benefit of Korean patent application 10-2018-0103992 filed on Aug. 31, 2018 in the Korean Intellectual Property Office, the entire disclosure of which is incorporated herein by reference.

BACKGROUND

1. Field

Aspects of some example embodiments of the present disclosure generally relate to a display device.

2. Description of the Related Art

In a display device such as an organic light emitting display (OLED) device, a liquid crystal display (LCD) device or a plasma display device, a pixel is degraded when driving time elapses, and therefore, an afterimage may occur. For example, when a fixed image, such as a logo or subtitle, is displayed with high luminance and/or is continuously displayed for a long time in a specific area of a display screen, degradation of the pixels may be accelerated, and therefore, an afterimage may occur.

In an effort to avoid accelerated degradation of pixels, a technique for moving and displaying an image on a display panel in a certain period may be utilized.

The Background section of the present Specification includes information that is intended to provide context to example embodiments, and the information in the present Background section does not necessarily constitute prior art.

SUMMARY

Aspects of some example embodiments of the present disclosure generally relate to a display device, and for example, to an image compensator, a display device including the same, and a method for driving the display device.

Aspects of some example embodiments include an image compensator for controlling an image shift direction and an image shift amount while simultaneously applying a first image shift and a second image shift to an image.

Aspects of some example embodiments may also include a method for driving a display device for controlling an image shift direction and an image shift amount while simultaneously applying a first image shift and a second image shift to an image.

According to some example embodiments of the present disclosure, an image compensator includes: a shift path updater configured to update a first preliminary shift direction of a fixed image included in an image in a preset first period according a first shift scenario, and update a second preliminary shift direction of the fixed image in a preset second period according a second shift scenario; a shift direction determiner configured to correct the first preliminary shift direction and the second preliminary shift direction respectively to a first target shift direction and a second target shift direction, based on a result obtained by comparing the first preliminary shift direction and the second preliminary shift direction; a first shift controller configured to perform a first image shift, based on the first target shift direction; and a second shift controller configured to perform a second image shift, based on the second target shift direction.

When the first preliminary shift direction and the second preliminary shift direction are opposite to each other, the shift direction determiner may reverse one of the first preliminary shift direction and the second preliminary shift direction.

When the first preliminary shift direction and the second preliminary shift direction are not opposite to each other, the shift direction determiner may determine the first preliminary shift direction and the second preliminary shift direction respectively as the first target shift direction and the second target shift direction.

When the first target shift direction and the second target shift direction are equal to each other, a shift amount of the fixed image may be larger than that of another portion of the image.

The first shift controller may shift a main area of the image in the first target shift direction.

The first shift controller may determine an upscaling area and a downscaling area, corresponding to the first target shift direction.

The second shift controller may shift the fixed image in the second target shift direction.

The second shift controller may determine an upscaling area and a downscaling area in a preset peripheral area surrounding the fixed image, corresponding to the second target shift direction.

When the first target shift direction and the second target shift direction are equal to each other, the shift amount of the fixed image may be larger than that of the main area.

When the first target shift direction and the second target shift direction are equal to each other, the shift amount of the fixed image may be two times of that of the main area.

The first shift controller may shift the downscaled image in the first target shift direction by downscaling the whole of the image to be smaller than a screen of a display panel.

The second shift controller may downscale image data of a portion out of the screen and upscale image data of a black portion of the display panel while shifting the whole of the image in the second target shift direction.

The shift direction determiner may include a shift amount controller configured to reverse at least one of the first preliminary shift direction and the second preliminary shift direction by comparing a limit shift amount from an original image, which is set with respect to shift directions, and a preliminary shift amount determined by a vector sum of the first preliminary shift direction and the second preliminary shift direction.

When the preliminary shift amount exceeds the limit shift amount, the shift amount controller may reverse a preliminary shift direction equal to a shift direction of the limit shift amount.

The shift direction determiner may include: an image analyzer configured to detect contour lines included in the image by analyzing input image data, and analyze a horizontal sum and a vertical sum of the contour lines; a first adjustor configured to adjust the first preliminary shift direction and the second preliminary shift direction, based on a result obtained by comparing the horizontal sum and the vertical sum; and a second adjustor configured to compare the adjusted first preliminary shift direction and the adjusted second preliminary shift direction, and reverse one of the adjusted first preliminary shift direction and the adjusted second preliminary shift direction when the adjusted first preliminary shift direction and the adjusted second preliminary shift direction are opposite to each other.

When the horizontal sum is larger than the vertical sum, the first adjustor may adjust the first preliminary shift direction and the second preliminary shift direction to a vertical direction.

When the vertical sum is larger than the horizontal sum, the first adjustor may adjust the first preliminary shift direction and the second preliminary shift direction to a horizontal direction.

The shift direction determiner may further include a shift amount controller configured to reverse at least one of the adjusted first preliminary shift direction and the adjusted second preliminary shift direction by comparing a limit shift amount set with respect to shift directions and a preliminary shift amount determined by a combination of preliminary shift directions output from the second adjustor.

The image compensator may further include a fixed image detector configured to detect the fixed image, based on the input image data.

The fixed image detector may include an artificial intelligence program that performs machine learning for detecting the fixed image.

According to some example embodiments of the present disclosure, in a method for driving a display device, the method includes: updating a first preliminary shift direction of a fixed image included in an image in a preset first period according a first shift scenario, and updating a second preliminary shift direction of the fixed image in a preset second period according a second shift scenario; when the first preliminary shift direction and the second preliminary shift direction are opposite to each other, determining a first target shift direction and a second target shift direction by reversing one of the first preliminary shift direction and the second preliminary shift direction; performing a first image shift, based on the first target shift direction; and performing a second image shift, based on the second target shift direction.

The determining of the first and second target shift directions may further include, when the first preliminary shift direction and the second preliminary shift direction are not opposite to each other, determining the first preliminary shift direction and the second preliminary shift direction respectively as the first target shift direction and the second target shift direction.

The determining of the first target shift direction and the second target shift direction may include: calculating a horizontal sum and a vertical sum of contour lines from input image data; adjusting the first preliminary shift direction and the second preliminary shift direction, based on a result obtained by comparing the horizontal sum and the vertical sum; and readjusting one of the adjusted first preliminary shift direction and the adjusted second preliminary shift direction, based on a result obtained by comparing the adjusted first preliminary shift direction and the adjusted second preliminary shift direction.

The adjusting of the first preliminary shift direction and the second preliminary shift direction may include: when the horizontal sum is larger than the vertical sum, adjusting the first and second preliminary shift directions to a vertical direction; and when the vertical sum is larger than the horizontal sum, adjusting the first and second preliminary shift directions to a horizontal direction.

The adjusting of the one of the adjusted first preliminary shift direction and the adjusted second preliminary shift direction may include: when the adjusted first preliminary shift direction and the adjusted second preliminary shift direction are equal to each other, determining the adjusted first preliminary shift direction and the adjusted second preliminary shift direction respectively as the first target shift direction and the second target shift direction; and when the adjusted first preliminary shift direction and the adjusted second preliminary shift direction are opposite to each other, reversing one of the adjusted first preliminary shift direction and the adjusted second preliminary shift direction.

The determining of the first target shift direction and the second target shift direction may further include: comparing a preliminary shift amount determined by a vector sum of the readjusted first and second preliminary shift directions and a preset limit shift amount; when the preliminary shift amount exceeds the limit shift amount, reversing one of the readjusted first and second preliminary shift directions; and when the preliminary shift amount is the limit shift amount or less, determining the readjusted first and second preliminary shift directions respectively as the first and second target shift directions.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
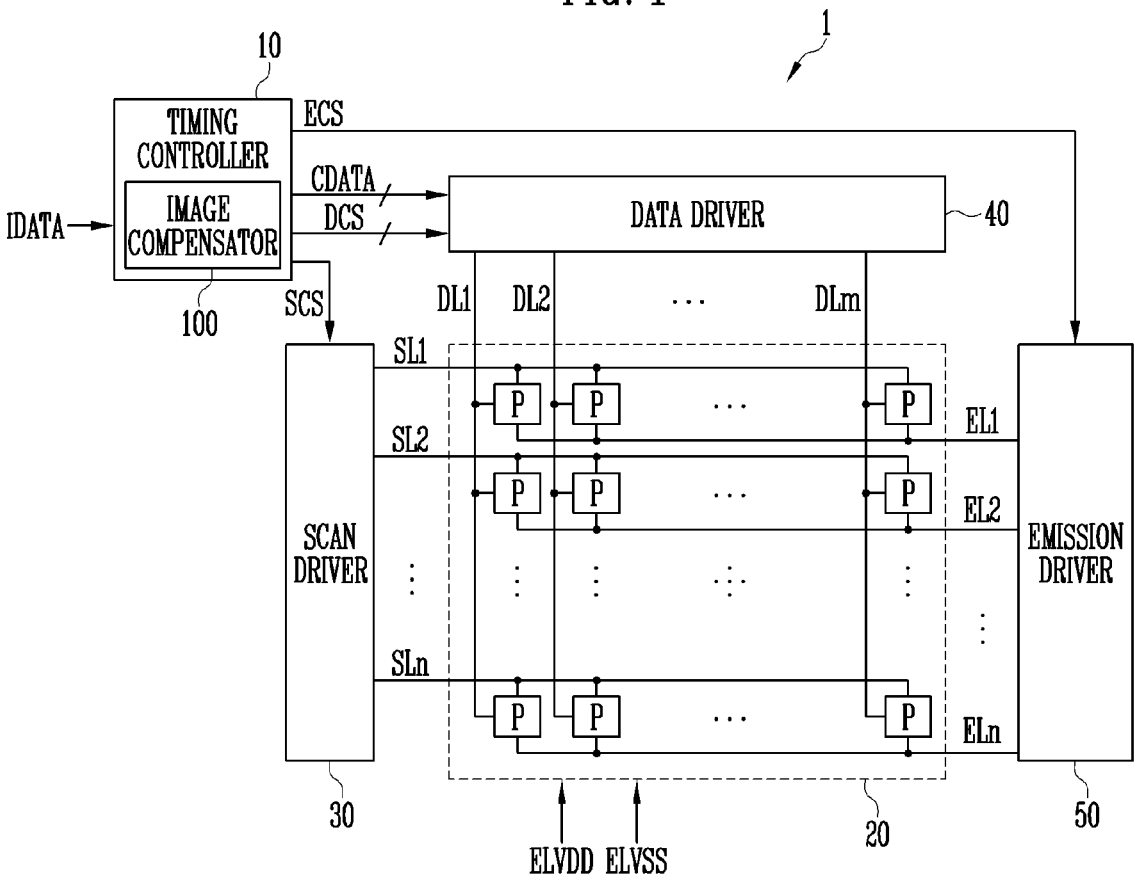
FIG. 1 is a block diagram illustrating a display device according to some example embodiments of the present disclosure.

Hereinafter, aspects of some example embodiments of the present disclosure will be described in more detail with reference to the accompanying drawings. Throughout the drawings, the same reference numerals are given to the same elements, and their overlapping descriptions will be omitted.

FIG. 1 is a block diagram illustrating a display device according to some example embodiments of the present disclosure.

Referring to FIG. 1, the display device 1 may include a timing controller 10, a display panel 20, a scan driver 30, a data driver 40, an emission driver 50, and an image compensator 100.

In some example embodiments, at least some components of the image compensator 100 may be included in the timing controller 10 and/or the data driver 40. Alternatively, the image compensator 100 may be configured with a separate hardware component and/or a separate software component.

In some example embodiments, the display device 1 may be implemented as an organic light emitting display device including a plurality of organic light emitting devices. However, this is merely illustrative, and the display device 1 may be implemented as a liquid crystal display device, a plasma display device, a quantum dot display device, or the like.

The display panel 20 may include a plurality of pixels P. The display panel 20 may be connected to the scan driver 30 through a plurality of scan lines SL1 to SLn, be connected to the emission driver 50 through a plurality of emission control lines EL1 to ELn, and be connected to the data driver 40 through a plurality of data lines DL1 to DLm. The display panel 20 may include m (m is a positive integer) pixel columns respectively connected to the data lines DL1 to DLm and n (n is a positive integer) pixel rows respectively connected to the scan lines SL1 to SLn and the emission control lines EL1 to ELn. The display panel 20 may display a shifted image, based on input image data DATA received from the outside or compensation image data CDATA generated by the image compensator 100.

The display panel 20 may display a main image including substantial image information and a fixed image. The fixed image may be an area displayed with a high luminance (high grayscale) for a certain time or more. For example, the fixed image may include a logo image such as a logo of a broadcasting company, a subtitle, a data, a time, etc.

When the display panel 20 displays a navigation image or GPS image, the fixed image may be a current position image of a user, which is displayed at a central side of the display panel 20.

The scan driver 30 may provide a scan signal to the display panel 20 through the plurality of scan lines SL1 to SLn. In an embodiment, each of the scan lines SL1 to SLn may be connected to pixels P located on a corresponding pixel row.

The data driver 40 may provide a data signal to the display panel 20 through the plurality of data lines DL1 to DLm according to the scan signal. In an embodiment, the data driver 40 may generate a data signal corresponding to the compensation image data CDATA, and provide the data signal to the display panel 20. In some example embodiments, each of the data lines DL1 to DLm may be connected to pixels P located on a corresponding pixel column of the display panel 20.

The emission driver 50 may provide an emission control signal to the display panel 20 through the plurality of emission control lines EL1 to ELn. In an embodiment, each of the emission control lines EL1 to ELn may be connected to pixels located to a corresponding pixel row.

The timing controller 10 may generate a plurality of control signals SCS, DCS, and ECS and provide the generated control signals to the scan driver 30, the data driver 40, and the emission driver 50, to control the scan driver 30, the data driver 40, and the emission driver 50. The timing controller 10 may receive an input control signal and input image data DATA from an image source such as an external graphic device. The input control signal may include a main clock signal, a vertical synchronization signal, a horizontal synchronization signal, and a data enable signal. The timing controller 10 may generate image data suitable for an operating condition of the display panel 20, based on the input image data DATA, and provide the generated image data to the data driver 40.

Also, the timing controller 10 may generate a first control signal SCS for controlling a driving timing of the scan driver 30, a second control signal DCS for controlling a driving timing of the data driver 40, and a third control signal ECS for controlling a driving timing of the emission driver 50, and provide the first, second and third control signals SCS, DCS, and ECS respectively to the scan driver 30, the data driver 40, and the emission driver 50. In some example embodiments, the image compensator 100 may be included in the timing controller 10. In another embodiment, the image compensator 100 may be arranged to be connected to the timing controller 10.

In order to prevent or reduce the occurrence of an after-image caused by a fixed image such as a logo, which is displayed through the same pixel P for a long time, an image may be shifted and displayed on the display panel 20.

The image compensator 100 may shift input image data DATA and an image in a preset period. The image compensator 100 may shift an image by combining two different image shift schemes (e.g., a first image shift and a second image shift) so as to maximize the shift effect of a fixed image and minimize degradation of the fixed image.

In some example embodiments, the image compensator 100 may include (as illustrated and described in more detail below): a shift path updater for updating a first preliminary shift direction of a fixed image included in an image in a preset first period according to a first shift scenario and updating a second preliminary shift direction of the fixed image in a preset second period according to a second shift scenario; a shift direction determiner for correcting the first preliminary shift direction and the second preliminary shift direction respectively to a first target shift direction and a second target shift direction, based on a result obtained by comparing the first preliminary shift direction and the second preliminary shift direction; a first shift controller for performing a first image shift, based on the first target shift direction; and a second shift controller for performing a second image shift, based on the second target shift direction.

Figure 2:
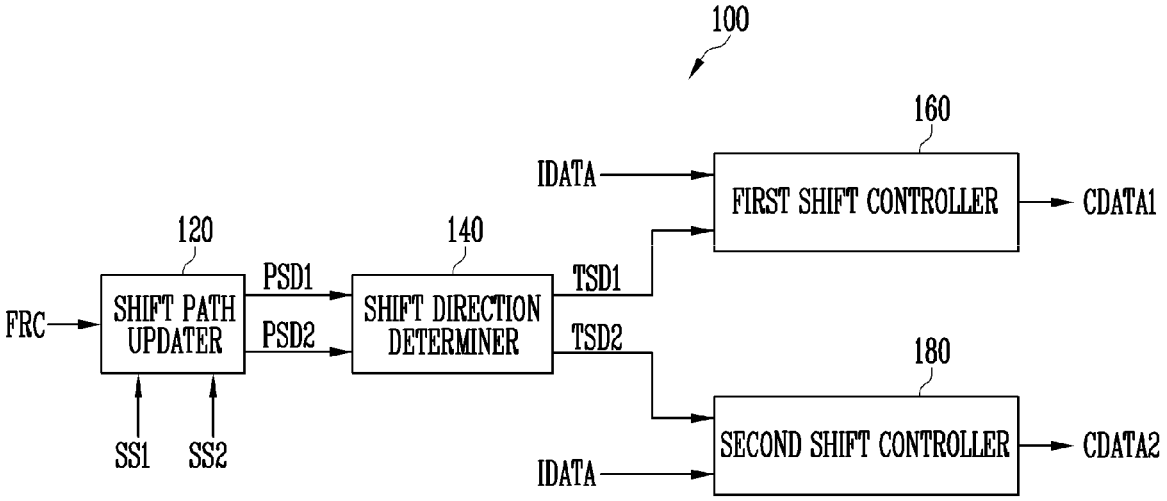
FIG. 2 is a block diagram illustrating an image compensator according to some example embodiments of the present disclosure.

FIG. 2 is a block diagram illustrating an image compensator 100 according to some example embodiments of the present disclosure.

Referring to FIGS. 1 and 2, the image compensator 100 may include a shift path updater 120, a shift direction determiner 140, a first shift controller 160, and a second shift controller 180.

The image compensator 100 may generate compensation image data CDATA, using input image data DATA and a frame count FRC. The compensation image data CDATA may be generated by combining image shift data output from the first shift controller 160 and image shift data output from the second shift controller 180. In some example embodiments, the compensation image data CDATA may be generated using a vector sum of the image shift data output from the first shift controller 160 and the image shift data output from the second shift controller 180. For example, the compensation image data CDATA may be shift image data obtained by shifting (moving) an original image generated by the input image data DATA in a predetermined direction.

The shift path updater 120 may update a first preliminary shift direction PSD1 in a preset first period according to a first shift scenario SS1. The first preliminary shift direction PSD1 may be applied to the whole of an image displayed in the display panel 20, or be applied only a portion of the image. In some example embodiments, the first shift scenario SS1 may be used in an operation of the first shift controller 160.

A shift direction may be determined as an X-axis direction (horizontal direction) or a Y-axis direction (vertical direction) in the display panel 20. However, this is merely illustrative, and the movement of an image in a preliminary shift direction may be a movement in a diagonal direction with respect to X and Y axes.

In an embodiment, the first preliminary shift direction PSD1 may influence on the position of a fixed image. The fixed image may include a logo image of a broadcasting company, a brand, etc. However, this is merely illustrative, and the fixed image may include all images continuously displayed with a high luminance in a specific area of a display screen for a long time.

The shift path updater 120 may update a second preliminary shift direction PSD2 in a preset second period according to a second shift scenario SS2. The second preliminary shift direction PSD2 may be applied to the whole of the image displayed in the display panel 20, or be applied only a portion of the image. For example, the second preliminary shift direction PSD2 may influence on the position of a fixed image. In an embodiment, the first shift scenario SS1 may be used in an operation of the first shift controller 160.

The first and second shift scenarios SS1 and SS2 may be stored in a predetermined memory, etc., or be extracted from a stored look-up table. Alternatively, the first and second shift scenarios SS1 and SS2 may be implemented with predetermined software or hardware for determining a shift direction in response to the frame count FRC.

The frame count FRC includes a number of frames in which an image is displayed, which may correspond to an image display time. An initial shift direction and an initial shift amount may be determined according to a shift direction and a shift direction, which are caused by the first and second shift scenarios SS1 and SS2.

In some example embodiments, the first period and the second period may be equal to each other. The first and second shift scenarios SS1 and SS2 may change the first and second preliminary shift directions PSD1 and PSD2 in the same period. For example, the first and second preliminary shift directions PSD1 and PSD2 may be updated at an interval of about 4 seconds.

In some example embodiments, the first period and the second period may be different from each other. The first period may be longer than the second period, or the second period may be longer than the first period. For example, the second period may be ½, ⅓ or ¼ of the first period. Alternatively, the first period and the second period may have a coprime relationship.

The shift direction determiner 140 may correct the first preliminary shift direction PSD1 and the second preliminary shift direction PSD2 respectively to a first target shift direction TSD1 and a second target shift direction TSD2, based on a result obtained by comparing the first preliminary shift direction PSD1 and the second preliminary shift direction PSD2.

In some example embodiments, when the first preliminary shift direction PSD1 and the second preliminary shift direction PSD2 are opposite to each other, the shift direction determiner 140 may reverse one of the first preliminary shift direction PSD1 and the second preliminary shift direction PSD2. That is, the one of the first preliminary shift direction PSD1 and the second preliminary shift direction PSD2 may be corrected to its opposite direction. When the first preliminary shift direction PSD1 is reversed, the reversed first preliminary shift direction PSD1 may be determined as the first target shift direction TSD1, and the second preliminary shift direction PSD2 may be determined as the second target shift direction TSD2.

On the contrary, when the first preliminary shift direction PSD1 and the second preliminary shift direction PSD2 are opposite to each other, the shift direction determiner 140 may determine the first preliminary shift direction PSD1 and the second preliminary shift direction PSD2 respectively as the first target shift direction TSD1 and the second target shift direction TSD2.

When the first target shift direction TSD1 and the second target shift direction TSD2 are equal to each other, a shift amount of the fixed image may be larger than that of an image at the other portion. For example, the shift amount of the fixed image may be two times of that of the image at the other portion. Accordingly, the shift effect of an image can maximized, and degradation caused by the fixed image and occurrence of an afterimage can be minimized.

Two types of shift algorithms may be used together so as to maximize image shift and minimize occurrence of an afterimage.

The first shift controller 160 may perform a first image shift on the input image data DATA, based on the first target shift direction TSD1. The first shift controller 160 may output first compensation image data CDATA1, using a first image shift operation. The first compensation image data CDATA1 may include shift amount information and shift direction information of the whole of the image or a predetermined area of the image.

The second shift controller 180 may perform a second image shift on the input image data DATA, based on the second target shift direction TSD2. The second shift controller 180 may output second compensation image data CDATA2, using a second image shift operation. The second compensation image data CDATA2 may include shift amount information and shift direction information of the whole of the image or a predetermined area of the image.

Compensation image data CDATA of a corresponding frame may be generated by combining the first compensation image data CDATA1 and the second compensation image data CDATA2.

In some example embodiments, the first shift controller 160 may downscale the whole of the image to be smaller than a screen of the display panel 20. The first shift controller 160 may shift the downscaled image in the first target shift direction TSD1. For example, the first compensation image data CDATA1 may include image data shifted by the first target shift direction TSD1 and some downscaled image data. In other words, the first shift controller 160 may operate using a boundary shift scheme.

The second shift controller 180 may downscale image data of a portion out of the screen of the display panel 20 and upscale image data of a black portion of the display panel 20 while shifting the whole of the image in the second target shift direction TSD2. For example, the second shift controller 180 may operate using an internal shift scheme.

In some example embodiments, the first shift controller 160 may shift a main area of the image or the whole of the image in the first target shift direction TSD1. For example, the first shift controller 160 may determine an upscaling area and a downscaling area, corresponding to the first target shift direction TSD1. For example, the first shift controller 160 may operate using a global shift scheme.

The second shift controller 180 may shift the fixed image in the second target shift direction TSD2. That is, the second shift controller 180 may control the shift of only a partial area of the image including the fixed image. For example, the second shift controller 180 may operate using a local shift scheme.

However, this is merely illustrative, and the driving method of the first shift controller 160 and the second shift controller 180 is not limited thereto. In addition, a finally shifted image may be displayed in the display panel 20 by combining the compensation image data CDATA1 and CDATA2 respectively calculated by the first and second shift controllers 160 and 180. For example, the image may be shifted using a vector sum of compensation image data CDATA1 and CDATA2 of the respective pixels.

Figure 3A:
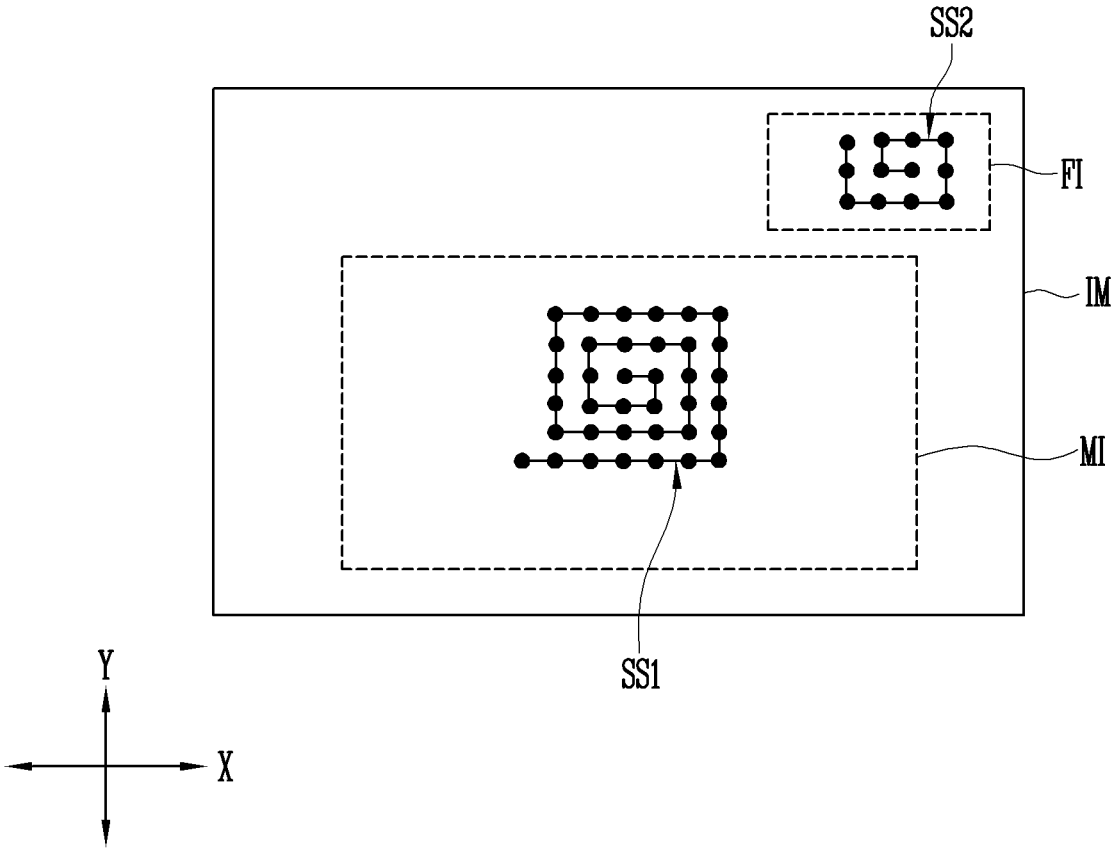
FIGS. 3A and 3B are diagrams illustrating an example of an operation of a first shift controller and a second shift controller, which are included in the image compensator of FIG. 2.
Figure 3B:
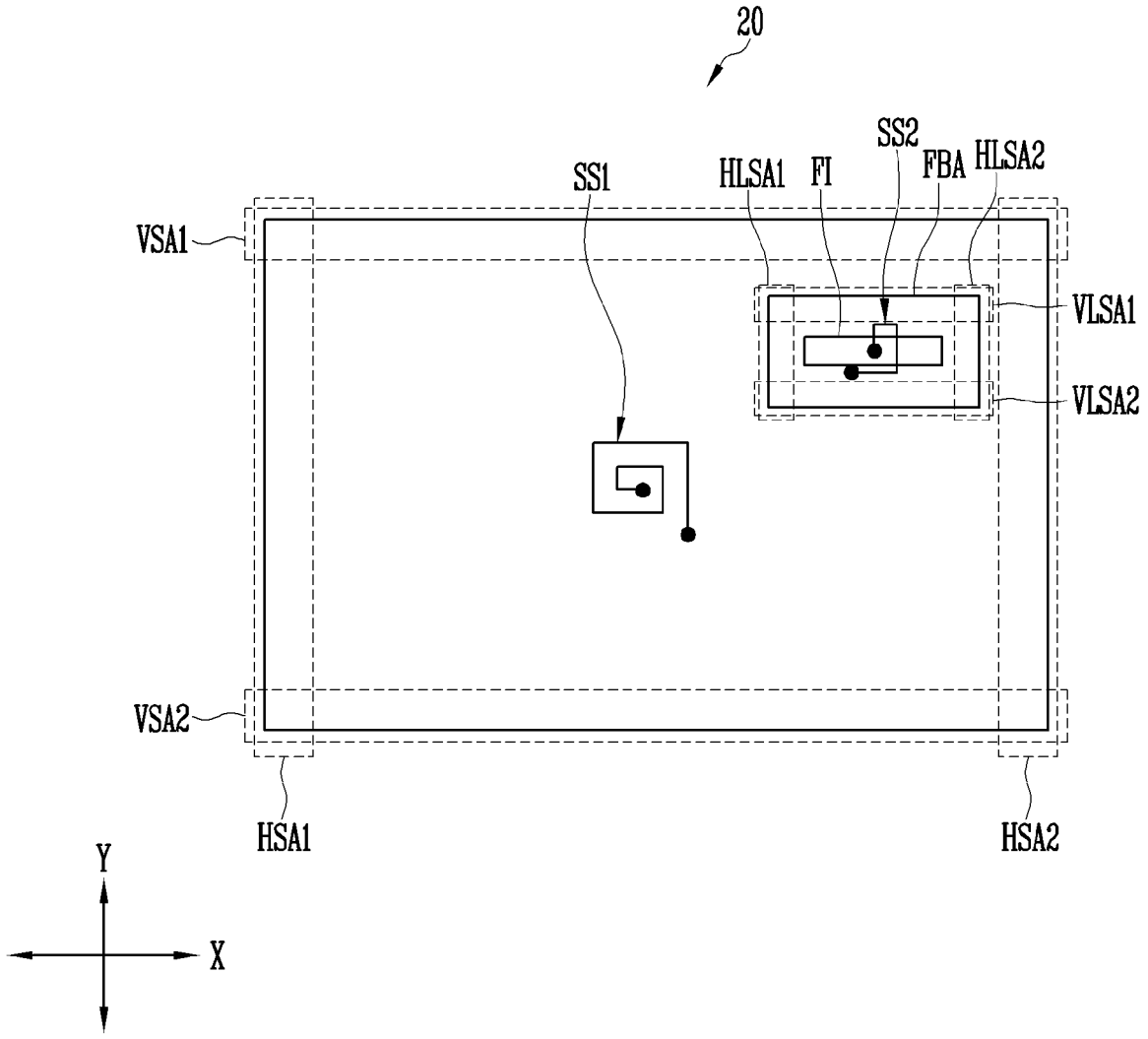

FIGS. 3A and 3B are diagrams illustrating an example of an operation of the first shift controller and the second shift controller, which are included in the image compensator of FIG. 2.

Referring to FIGS. 1 to 3B, the first shift controller 160 and the second shift may shift an image respectively according to the first shift scenario SS1 and the second shift scenario SS2.

In some example embodiments, an image IM may include a fixed image FI including a logo, etc. Although a case where the fixed image FI is displayed at a left top end of the image IM is illustrated in FIGS. 3A and 3B, the position of the fixed image FI is not limited thereto. For example, in the case of a navigation screen, a current position image of a user may be analyzed as the fixed image FI, and the fixed image FI may be located at the center of the image IM.

In some example embodiments, the first shift controller 160 may shift a main image MI including the fixed image FI according to the first shift scenario SS1. The main image MI may be moved by 1 pixel in an X-axis direction X or Y-axis direction Y for every first period. As shown in FIG. 3A, the main image MI may be shifted along a spiral path, and be moved clockwise or counterclockwise.

However, the first shift scenario SS1 may be corrected by the shift direction determiner 140. Accordingly, the first shift controller 160 may shift the main image MI along the first target shift direction TSD1.

For example, the first shift controller 160 may perform image data scaling, corresponding to the first target shift direction TSD1. For example, the first shift controller 160 may implement an image shift effect by upscaling or downscaling input image data DATA corresponding to edge areas of the image IM.

An image may be enlarged in an upscaling area, and an image may be reduced in a downscaling area. That is, the main image MI may be shifted in a direction from the upscaling area in which image data is upscaled to the downscaling area in which image data is downscaled.

For example, when the main image MI is moved to a right side, the upscaling may be performed in a left scaling area HSA1, and the downscaling may be performed in a right scaling area HSA2. When the main image MI is moved to a lower side, the upscaling may be performed in an upper scaling area VSA1, and the downscaling may be performed in a lower scaling area VSA2.

The second shift controller 180 may perform image shift, using the substantially same scheme as the first shift controller 160. However, the second shift controller 180 may perform image scaling and image shift on a local portion including the fixed image FI.

For example, the second shift controller 180 may shift the fixed image FI by determining an upscaling area and a downscaling area with respect to a preset peripheral area FBA at the periphery of the fixed image FI. That is, the fixed image FI may be shifted through scaling of image data included in scaling areas HLSA1, HLSA2, VLSA1, and VLSA2 of the peripheral area FBA.

As described above, in some example embodiments, the first and second shift controllers 160 and 180 may perform image shift, respectively using a global shift control scheme and a local shift control scheme, which use image data scaling.

The shift effects caused by the first shift controller 160 and the second shift controller 180 may be overlappingly applied to the fixed image FI.

Figure 4A:
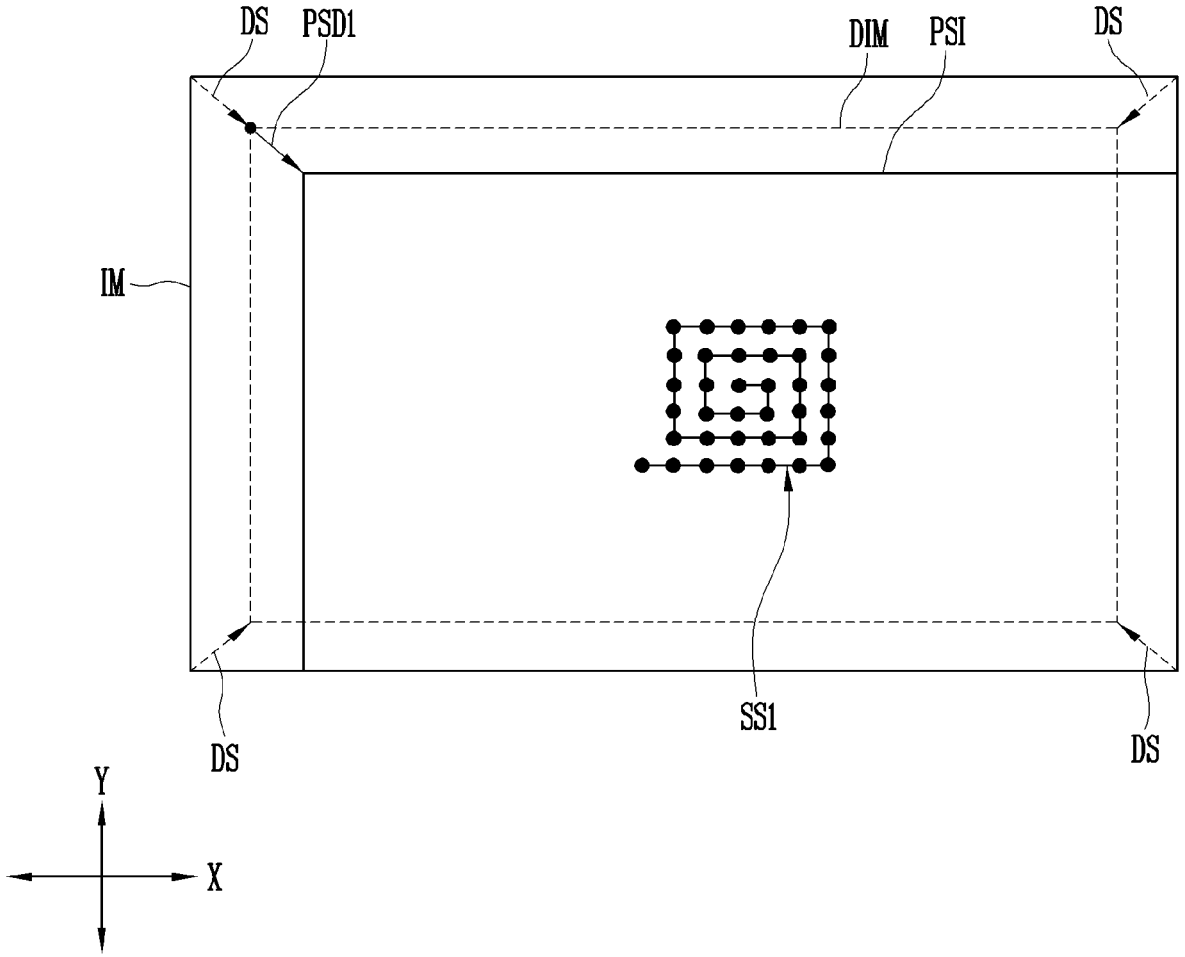
FIGS. 4A and 4B are diagrams illustrating an example of an operation of the first shift controller and the second shift controller, which are included in the image compensator of FIG. 2.
Figure 4B:
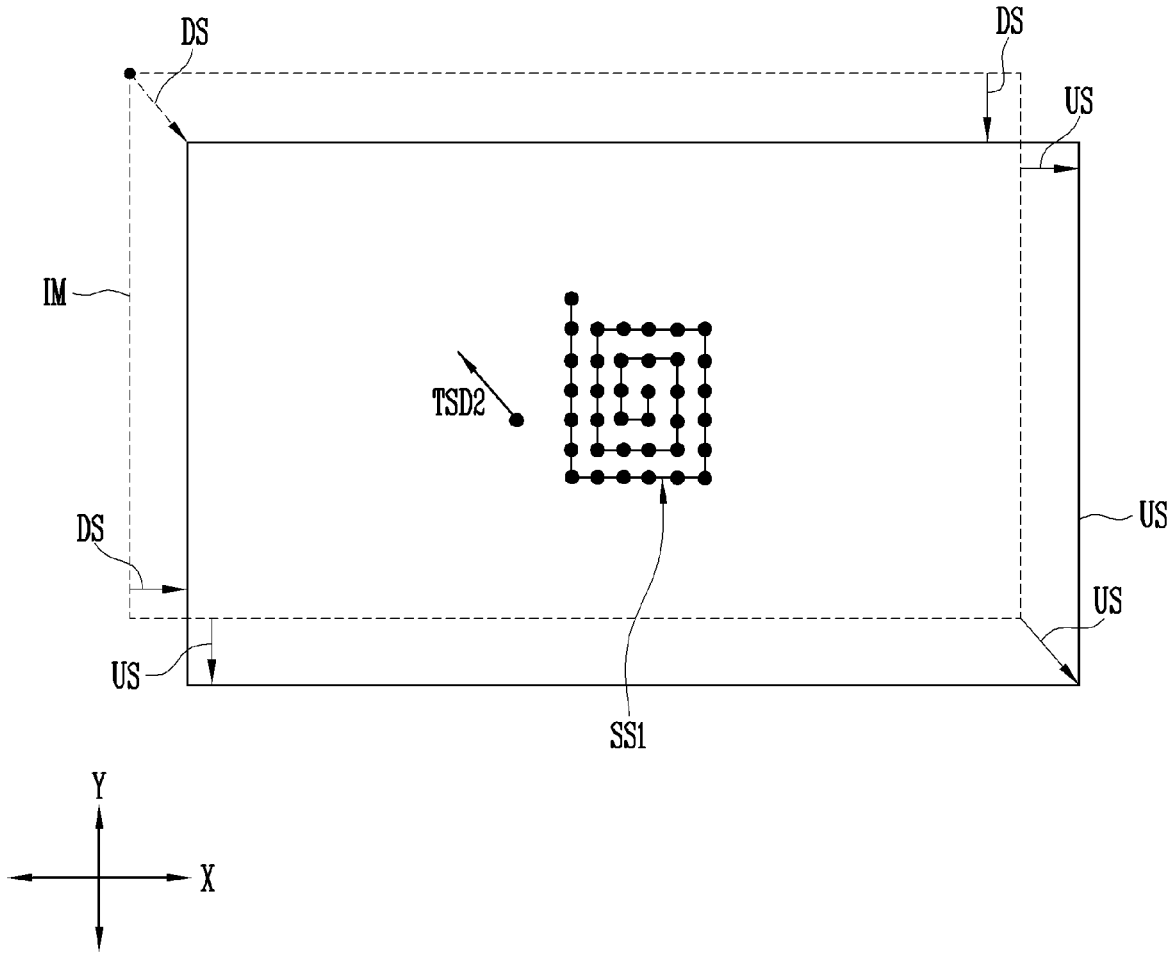

FIGS. 4A and 4B are diagrams illustrating an example of an operation of the first shift controller and the second shift controller, which are included in the image compensator of FIG. 2.

Referring to FIGS. 1, 2, 4A, and 4B, the first shift controller 160 and the second shift controller 180 may shift an image respectively according to the first shift scenario SS1 and the second shift scenario SS2.

In an embodiment, as shown in FIG. 4A, the first shift controller 160 may shift a downscaled image DIM by downscaling (DS) the whole of the image IM to be smaller than the screen of the display panel 20. The downscaled image DIM may be shifted according to the first shift scenario SS1. However, the first shift scenario SS1 may be corrected to the first target shift direction TSD1 by the shift direction determiner 140. The downscaled image DIM may be shifted along the first target shift direction TSD1.

A black image may be viewed at an outer edge of the image IM by the downscaled image DIM. In order to prevent or reduce visibility failure, the second shift controller 180 may additionally perform image correction and image shift.

The second shift controller 180 may downscale (DS) image data of a portion out of the screen and upscale (US) image data of a black portion while shifting the whole of the image IM in the second target shift direction TSD1. Accordingly, a portion at which an image is cut off by the scaling and shifting and a portion at which a black image is displayed when the image is cut off can be removed.

The image IM may be shifted in a direction from the upscaling area in which image data is upscaled to the downscaling area in which image data is downscaled.

According to the shift scheme of FIGS. 4A and 4B, the shift effects caused by the first shift controller 160 and the second shift controller 180 may be overlappingly applied at a central portion of the image IM. The shift scheme of FIGS. 4A and 4B may be mainly applied to a screen such as a navigation screen, on which a fixed image is displayed at the center of the image IM.

In some example embodiments, an operating method of the first and second shift controllers 160 and 180 may be selected according to the position of the fixed image FI. For example, when the fixed image FI is located at an outer edge portion of the image IM, the first and second shift controllers 160 and 180 may use the shift scheme of FIGS. 3A and 3B. On the other hand, when the fixed image FI is located at a central portion of the image IM, the first and second shift controllers 160 and 180 may use the shift scheme of FIGS. 4A and 4B.

In some example embodiments, the image compensator 100 may further include a fixed image detector for detecting the fixed image FI by analyzing the input image data DATA. An operating method of the first and second shift controllers 160 and 180 may be selected based on the detection result of the fixed image detector.

Meanwhile, contents described with reference FIGS. 3A to 4B merely describe examples of the method in which the first and second shift controllers 160 and 180 shift an image, respectively corresponding to the first and second target shift directions TSD1 and TSD2, and the method of displaying images corresponding to the first and second target shift directions TSD1 and TSD2 or the method of correcting image data is not limited thereto.

FIGS. 5A to 5D are diagrams illustrating examples of an operation of the shift direction determiner included in the image compensator of FIG. 2.

Referring to FIGS. 1, 2, 5A, 5B, 5C, and 5D, the shift direction determiner 140 may correct the first preliminary shift direction PSD1 and the second preliminary shift direction PSD2 respectively to the first target shift direction TSD1 and the second target shift direction TSD2, based on a result obtained by comparing the first preliminary shift direction PSD1 and the second preliminary shift direction PSD2.

The shift path updater 120 may output the first preliminary shift direction PSD1, corresponding to the first period, and output the second preliminary shift direction PSD2, corresponding to the second period. A case where the first preliminary shift direction PSD1 and the second preliminary shift direction PSD2 are opposite to each other occurs at a predetermined time.

Figure 5A:
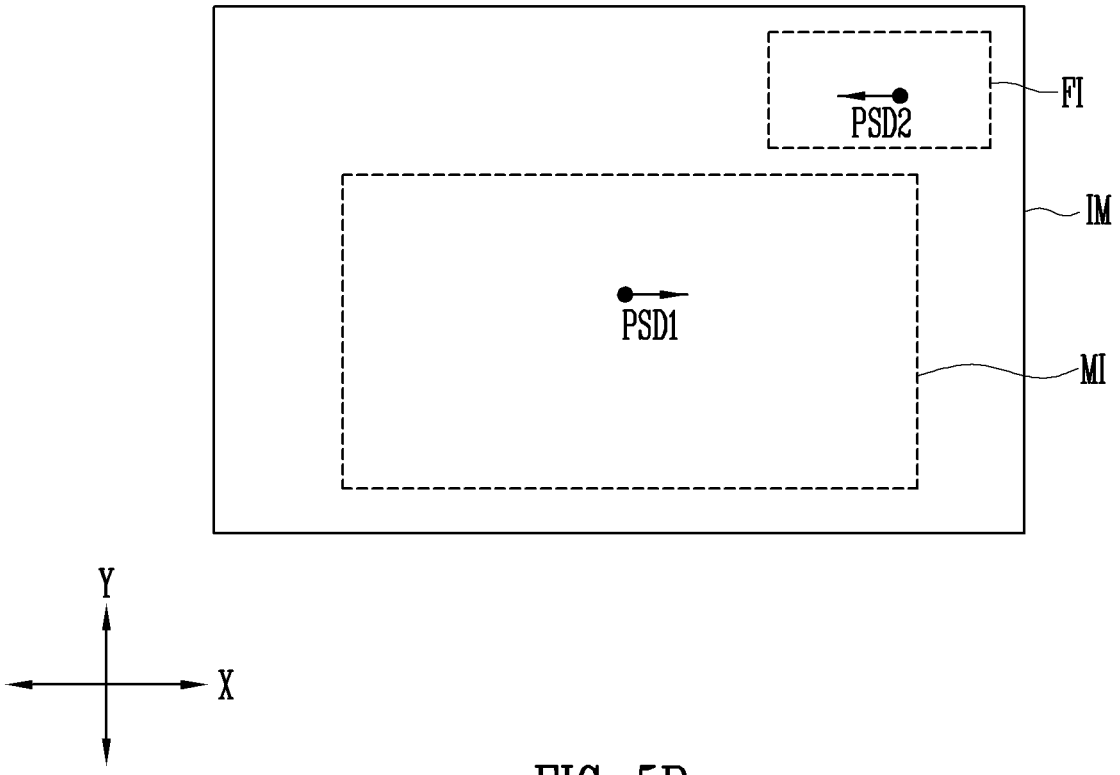
FIGS. 5A to 5D are diagrams illustrating examples of an operation of a shift direction determiner included in the image compensator of FIG. 2.
Figure 5B:
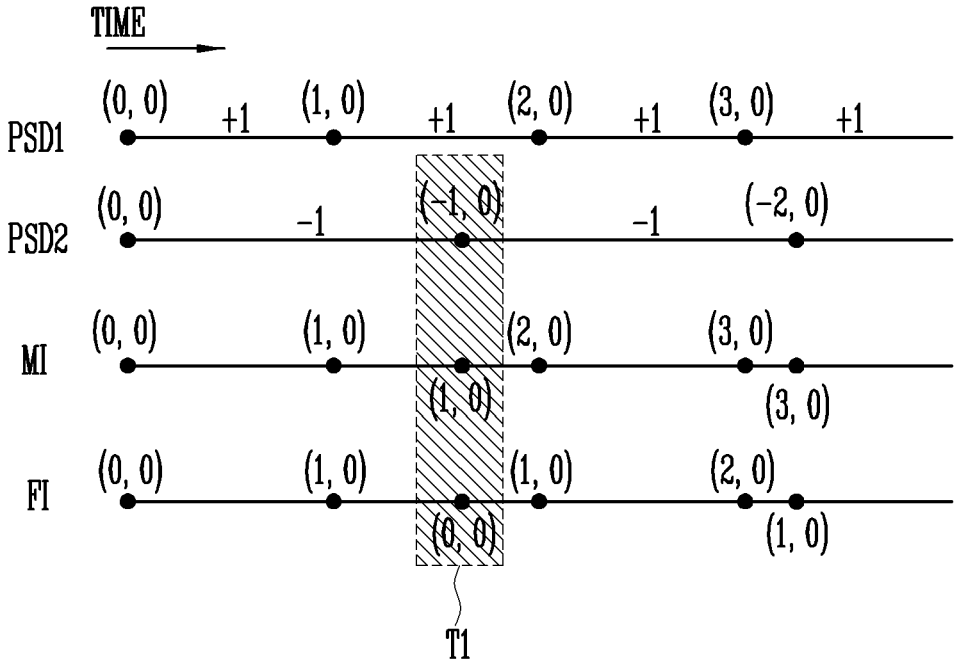

For example, as shown in FIGS. 5A and 5B, the second preliminary shift direction PSD2 may be updated to the opposite direction of the first preliminary shift direction PSD1 at a first time T1.

FIG. 5B shows an example in which each of the main image MI and the fixed image is shifted according to the first preliminary shift direction PSD1 updated according to the first shift scenario SS1, the second preliminary shift direction PSD2 updated according to the second shift scenario SS2, and the first and second preliminary shift directions PSD1 and PSD2 without any operation of the shift direction determiner 140.

In drawings from FIG. 5B, (1, 0) may mean a position at which an original image is moved by 1 pixel in the X-axis direction X (i.e., moved by 1 pixel to a right side), and (−1, 0) may mean a position at which the original image is moved by −1 pixel in the X-axis direction X (i.e., moved by 1 pixel to a left side). In addition, (0, 1) may mean a position at which the original image moved by 1 pixel in the Y-axis direction Y (i.e., moved by 1 pixel to an upper side), and (0, −1) may mean a position at which the original image is moved by −1 pixel in the Y-axis direction Y (i.e., moved by 1 pixel to a lower side).

In an embodiment, the main image MI may receive only influence of the first shift controller 160 (the first preliminary shift direction PSD1 or the first target shift direction TSD1). Therefore, in FIG. 5B, the main image MI may be shifted along the first preliminary shift direction PSD1.

In an embodiment, the fixe image FI may receive influence of both the first shift controller 160 (the first preliminary shift direction PSD1 or the first target shift direction TSD1) and the second shift controller 180 (the second preliminary shift direction PSD2 or the second target shift direction TSD2). Therefore, the fixed image FI may be shifted by a combination of the first preliminary shift direction PSD1 and the second preliminary shift direction PSD2.

Hereinafter, a case where the first shift controller 160 operates using the global shift scheme and the second shift controller 180 operates using the local shift scheme will be described. However, this is merely illustrative, and the first and second shift controllers 160 and 180 are not limited thereto. For example, the first and second shift controllers 160 and 180 may operate using any scheme known in the art.

At the first time T1, the first preliminary shift direction PSD1 is (1, 0), and the second preliminary shift direction PSD2 is (−1, 0). Accordingly, the shift effect of the fixed image FI is cancelled. That is, the fixed image FI is not shifted at the first time T1. At a subsequent time after the first time T1, a shift amount of the fixed image FI becomes smaller than that of the main image MI due to a combination of the first preliminary shift direction PSD1 and the second preliminary shift direction PSD2.

In order to solve this problem, the shift direction determiner 140 may correct at least one of the first preliminary shift direction PSD1 and the second preliminary shift direction PSD2.

In an embodiment, the shift direction determiner 140 may compare the first preliminary shift direction PSD1 and the second preliminary shift direction PSD2 at a time at which the first preliminary shift direction PSD1 is updated and a time at which the second preliminary shift direction PSD2 is updated. The shift direction determiner 140 may output the first and second target shift directions TSD1 and TSD2, based on the comparison result.

When the first preliminary shift direction PSD1 and the second preliminary shift direction PSD2 are opposite to each other, the shift direction determiner 140 may reverse one of the first preliminary shift direction PSD1 and the second preliminary shift direction PSD2. When the first preliminary shift direction PSD1 and the second preliminary shift direction PSD2 are not opposite to each other, the shift direction determiner 140 may determine the first preliminary shift direction PSD1 and the second preliminary shift direction PSD2 respectively as the first target shift direction TSD1 and the second target shift direction TSD2.

Figure 5C:
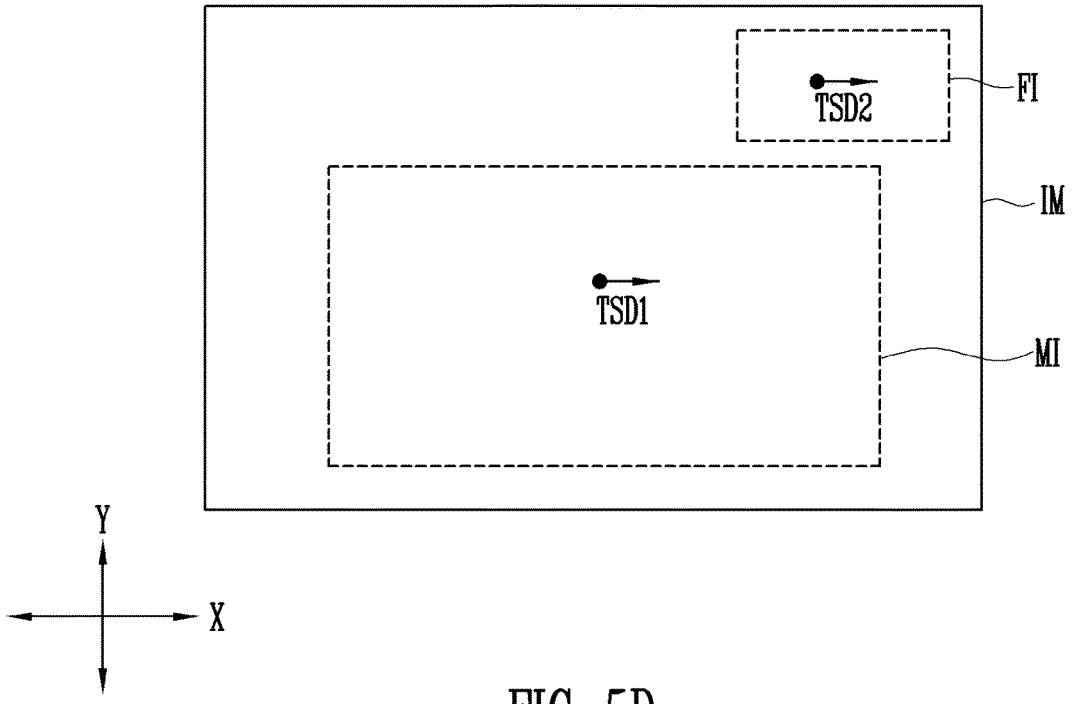
Figure 5D:
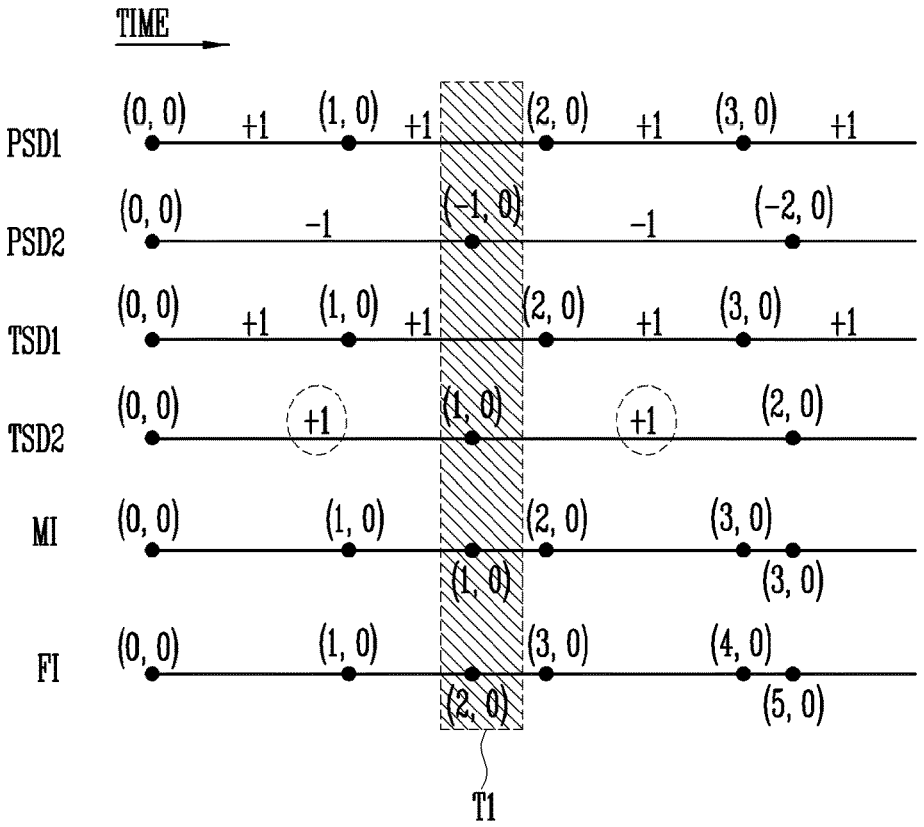

FIGS. 5C and 5D illustrate the first and second target shift directions TSD1 and TSD2 output by the shift direction determiner 140.

Because the first target shift direction TSD1 and the second target shift direction TSD2 are opposite to each other at the first time T1, the second target shift direction TSD2 may be reversed. At the first time T1, the second target shift direction TSD2 may be determined as (1, 0) by the reversed second preliminary shift direction PSD2.

However, this is merely illustrative, and the first preliminary shift direction PSD1 may be reversed instead of the second preliminary shift direction PSD2.

Accordingly, at the first time T1, the fixed image FI may be shifted by 2 pixels in the X-axis direction X. The shift amount of the fixed image FI may be larger than that of the main image MI.

As described above, when shift directions of at least some portions of an image to which first and second image schemes are applied conflict with (e.g., opposite to) each other, the shift direction determiner 140 reverses one preliminary shift direction, so that the shift amount of the image can be reinforced and/or increased. Thus, the degradation distribution amount of the pixel can be increased, and particularly, the degradation distribution amount of the fixed image FI can be increased. Accordingly, an image shift effect for reducing an afterimage can be maximized or improved.

However, this is merely illustrative, and driving of the shift direction determiner 140 and driving for changing shift directions may be applied such that the shift amount of an image can be maximized (or improved) not only when the shift directions conflict with each other but also when two different shift schemes are complexly applied to the image.

FIGS. 6A to 6D are diagrams illustrating examples of an operation of the shift direction determiner included in the image compensator of FIG. 2.

In FIGS. 6A to 6D, components identical to those described with reference to FIGS. 5A to 5D are designated by like reference numerals, and some overlapping descriptions will be omitted.

Referring to FIGS. 2 and 6A to 6D, the shift direction determiner 140 may reverse the first preliminary shift direction PSD1 and the second preliminary shift direction PSD2, based on a result obtained by comparing the first preliminary shift direction PSD1 and the second preliminary shift direction PSD2.

In an embodiment, the first period in which the first preliminary shift direction PSD1 is updated and the second period in which the second preliminary shift direction PSD2 is updated may be equal to each other.

Figure 6A:
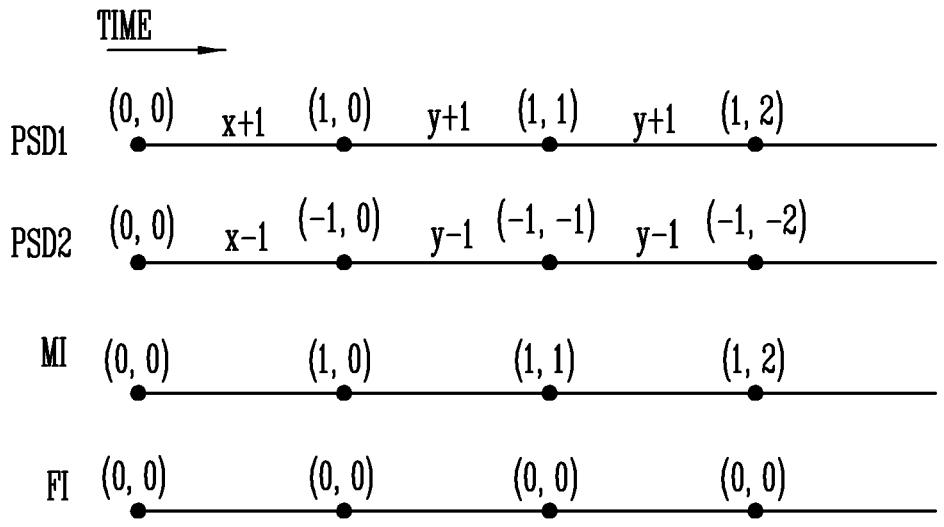
FIGS. 6A to 6D are diagrams illustrating examples of an operation of the shift direction determiner included in the image compensator of FIG. 2.

As shown in FIG. 6A, the first shift scenario SS1 and the second shift scenario SS2 may be opposite to each other. When the shift direction determiner 140 does not exist, a shift effect may be cancelled in a predetermined area (e.g., the fixed image FI). Although a case where the area in which the shift effect is cancelled is the fixed image FI, the present disclosure is not limited thereto. For example, the area in which the shift effect is cancelled includes an area that receives influence of both the image shift of the first shift controller 160 and the image shift of the second shift controller 180 in the whole of the image IM.

Figure 6B:
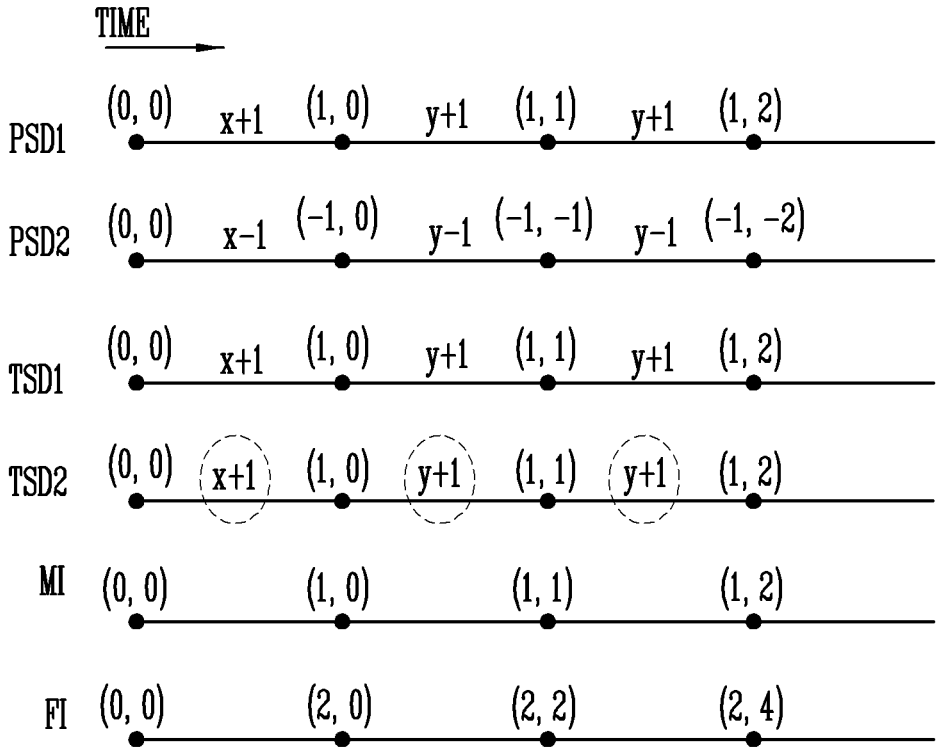
Figure 6C:
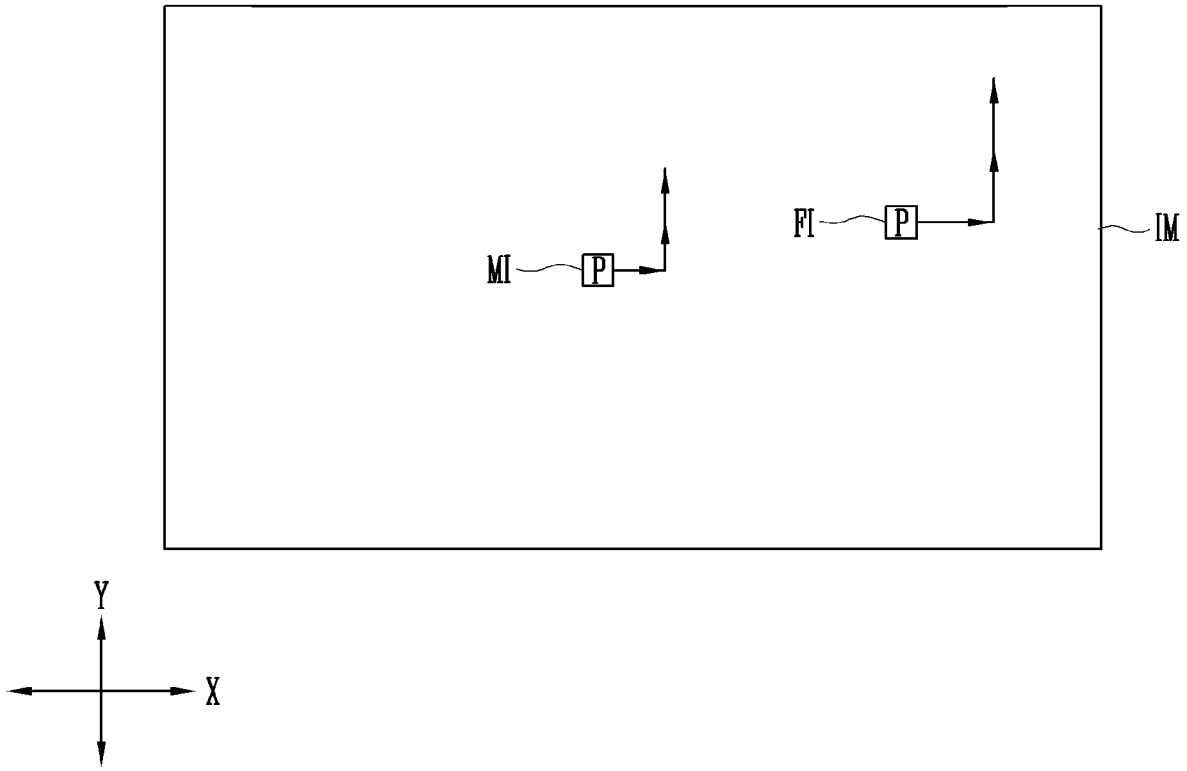

As shown in FIG. 6B, when the first preliminary shift direction PSD1 and the second preliminary shift direction PSD2 are opposite to each other, the second preliminary shift direction PSD2 may be reversed to be determined as the second target shift direction TDS2. The first preliminary shift direction PSD1 may be determined as the first target shift direction TSD1 without any change. Accordingly, a shift amount of the fixed image FI to which both the first and second target shift directions TSD1 and TSD2 are applied may be larger than that of the main image MI to which only the first target shift direction TSD1 is applied. For example, as shown in FIGS. 6B and 6C, the shift amount of the fixed image FI may be two times of that of the main image MI.

However, this is merely illustrative, and an image to which both the first and second target shift directions TSD1 and TSD2 are applied is not limited to the fixed image. For example, a portion to which both the first and second target shift directions TSD1 and TSD2 are applied in the whole of the image IM may be defined as a first image area, and a portion to which only the first target shift direction TSD1 is applied in the whole of the image IM may be defined as a second image area.

Figure 6D:
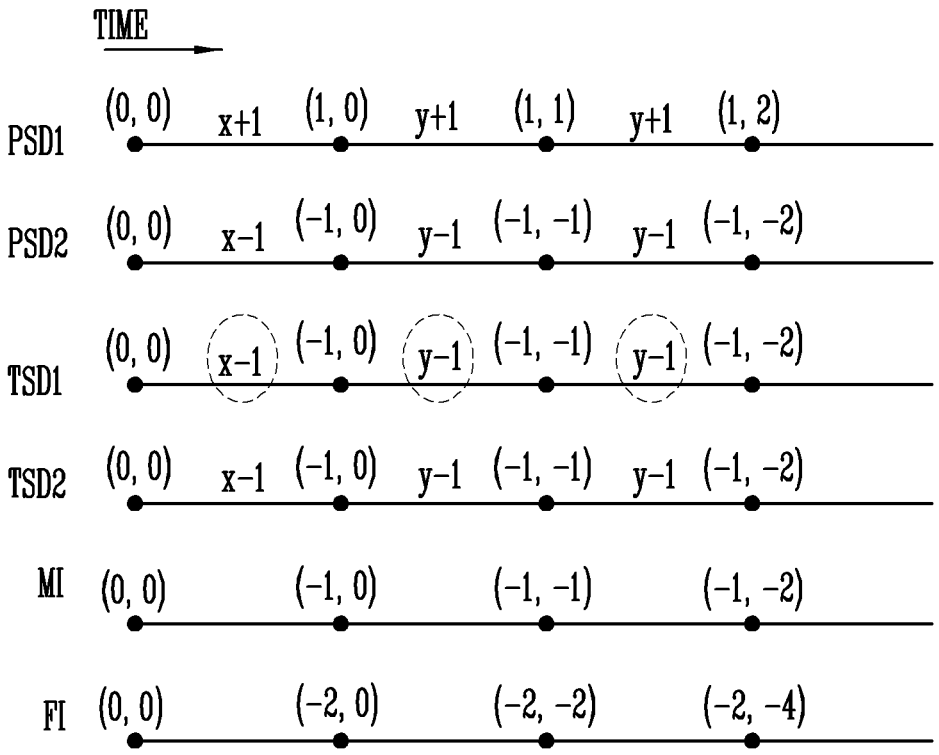

In an embodiment, as shown in FIG. 6D, when the first preliminary shift direction PSD1 and the second preliminary shift direction PSD2 are opposite to each other, the first preliminary shift direction PSD1 may be reversed to be determined as the first target shift direction TSD1. The main image MI and the fixed image FI may be shifted in a direction opposite to the shift direction of FIG. 6C.

As described above, when a shift effect is cancelled or reduced by the first shift scenario SS1 and the second shift scenario SS2, the shift direction determiner 140 reverses one preliminary shift direction, so that the shift amount of the image can be reinforced and/or increased. Thus, the degradation distribution amount of the pixel can be increased, and particularly, the degradation distribution amount of the fixed image FI can be increased. Accordingly, an image shift effect for reducing an afterimage can be maximized.

Figure 7A:
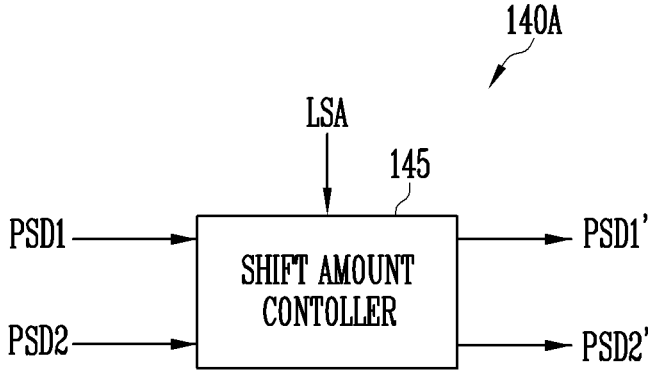
FIG. 7A is a diagram illustrating an example of the shift direction determiner included in the image compensator of FIG. 2.
Figure 7B:
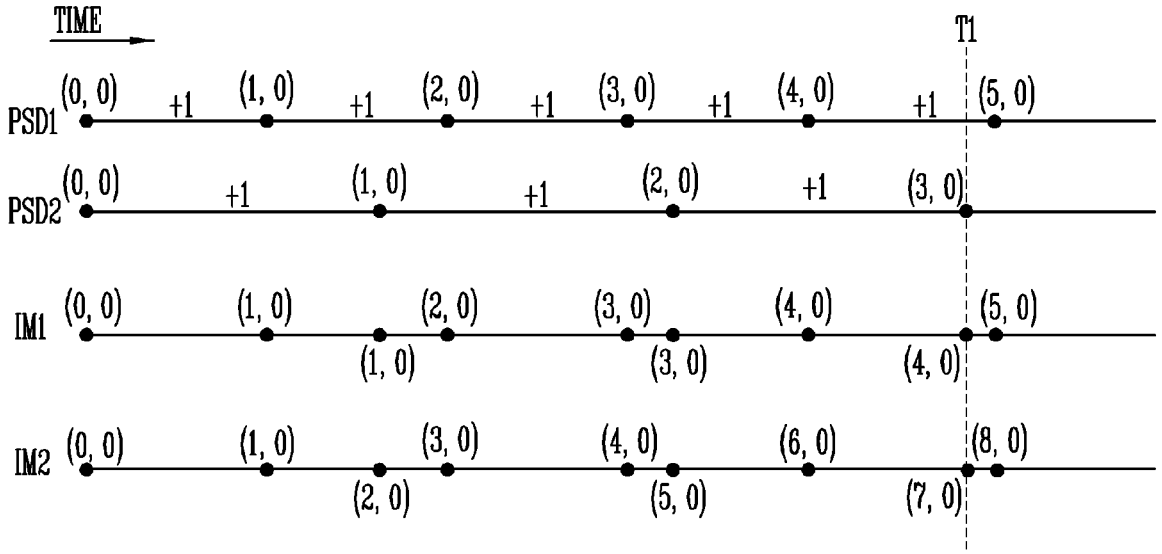
FIGS. 7B and 7C are diagrams illustrating an example of an operation of the shift direction determiner of FIG. 7A.
Figure 7C:
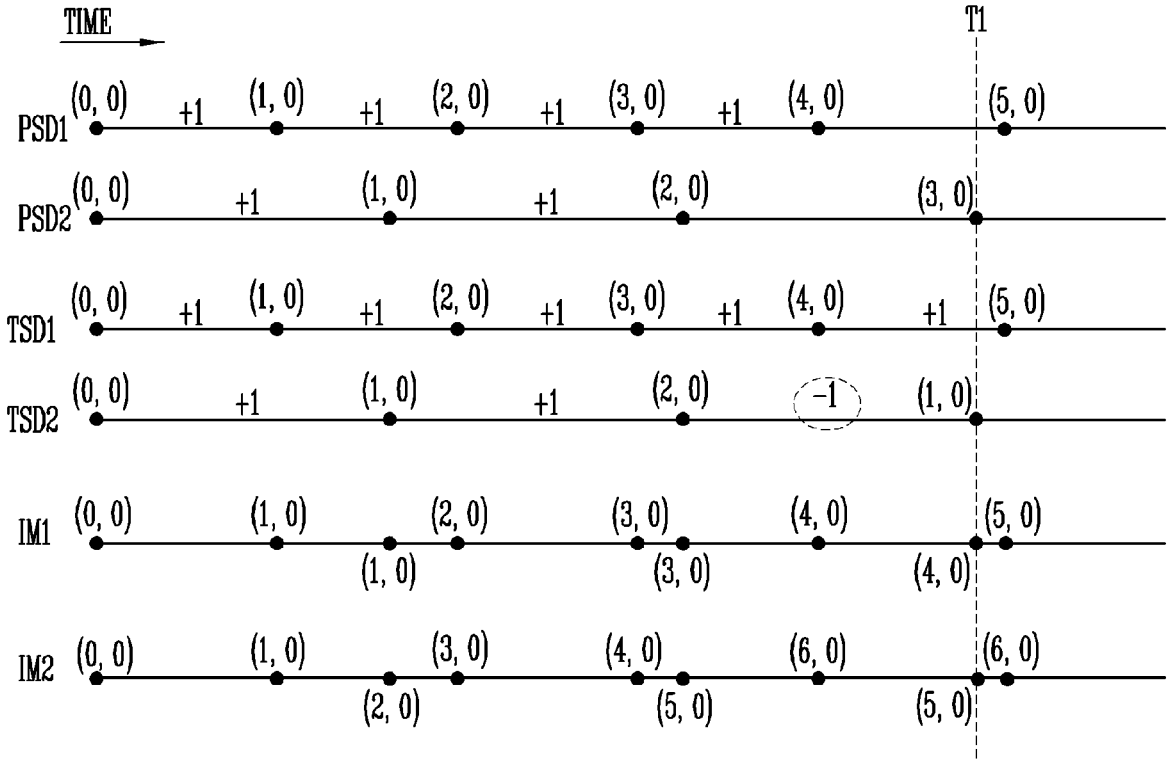

FIG. 7A is a diagram illustrating an example of the shift direction determiner included in the image compensator of FIG. 2. FIGS. 7B and 7C are diagrams illustrating an example of an operation of the shift direction determiner of FIG. 7A.

Referring to FIGS. 2 and 7A to 7C, the shift direction determiner 140A may include a shift amount controller 145.

The shift amount controller 145 may reverse at least one of the first preliminary shift direction PSD1 and the second preliminary shift direction PSD2 by comparing a limit shift amount LSA from an original image and a preliminary shift amount.

The limit shift amount LSA may be a maximum shift amount from the original image, which is set with respect to shift directions. For example, the limit shift amount LSA may be set to +/−10 pixels in the X-axis direction X and +/−15 pixels in the Y-axis direction Y. That is, the original image may be moved up to 10 pixels to the left/right and 15 pixels to the top/bottom. However, this is merely illustrative, and the limit shift amount LSA is not limited thereto. For example, a limit shift amount in the X-axis direction X and a limit shift amount in the Y-axis direction Y may be equal to each other.

The preliminary shift amount may have a net shift amount in the X-axis direction X and a net shift amount in the Y-axis direction Y, which are determined by a combination of the first preliminary shift direction PSD1 and the second preliminary shift direction PSD2. For example, the preliminary shift amount may be determined by a vector sum of the first preliminary shift direction PSD1 and the second preliminary shift direction PSD2.

Alternatively, the preliminary shift amount may have a net shift amount in the X-axis direction X and a net shift amount in the Y-axis direction Y, which are determined by a combination of the first target shift direction TSD1 and the second target shift direction TSD2. That is, after the first target shift direction TSD1 and the second target shift direction TSD2 are calculated, the preliminary shift amount may be calculated using the first target shift direction TSD1 and the second target shift direction TSD2. The first and second target shift directions TSD1 and TSD2 may be verified and corrected once more by the shift amount controller 145 before the preliminary shift amount is finally output.

In an embodiment, when the preliminary shift amount exceeds the limit shift amount LSA, the shift amount controller 145 may reverse a preliminary shift direction equal to the shift direction of the limit shift amount LSA (i.e., designated as PSD1' and PSD2'). When the preliminary shift amount is the limit shift amount LSA or less, the first and second preliminary shift directions PSD1 and PSD2 may be determined as the first and second target shift directions TSD1 and TSD2, or the pre-calculated first and second target shift directions TSD1 and TSD2 may be output as they are.

For example, as shown in FIG. 7B, a first image IM1 and a second image IM2 may be continuously shifted to a right side by updating the first and second preliminary shift directions PSD1 and PSD2.

Each of the first image IM1 and the second image IM2 may be at least a portion of an image displayed in the display panel. For example, the second image IM2 may be included in a portion of the first image IM1. Alternatively, the first image IM1 and the second image IM2 may be images displayed while being spaced apart from each other. The first image IM1 may be an image shifted by an operation of the first shift controller 160, and the second image IM2 may be an image shifted by an operation of the second shift controller 180.

Therefore, the first image IM1 may be moved by 1 pixel to the right side at an internal of a first period, and the second image IM2 may be moved by 1 pixel to the right side for every first period and for every second period.

At a first time T1, the first shift controller 160 may move the first image IM1 and the second image IM2 by 4 pixels to the right side, and the second shift controller 180 may move the second image IM2 by 3 pixels to the right. Accordingly, at the first time T1, the second image IM2 may be moved by 7 pixels to the right side from the original image to be displayed.

As described above, the second image IM2 may be excessively shifted due to shift reinforce according to simultaneous application of the first and second shift controller 160 and 180. When the shift amount in one direction is excessive, an image shift may be recognized by a user, or image distortion may occur.

The shift amount controller 145 may control a shift amount by setting the limit shift amount LSA. In an example, as shown in FIG. 7C, the limit shift amount LSA may be set to 6 pixels with respect to each of the upper/lower/left/right. According to the first and second preliminary shift directions PSD1 and PSD2, the shift amount of the second image IM2 becomes 7 pixels at the first time T1, and hence the shift amount controller 145 may reverse the second preliminary shift direction PSD2 or the second target shift direction TSD2 at the first time T1. That is, the second target shift direction TSD2 may be a direction in which the second image IM2 is moved by 1 pixel to the left side from a previous shift direction.

Therefore, at the first time T1, the second image IM2 may be shifted by 5 pixels to the right side to be displayed. Accordingly, the first and second images IM1 and IM2 can be periodically moved within the limit shift amount LSA by the shift amount controller 145. Thus, an excessive image shift and image distortion, caused by an operation of the shift direction determiner 140, can be suppressed.

Figure 8A:
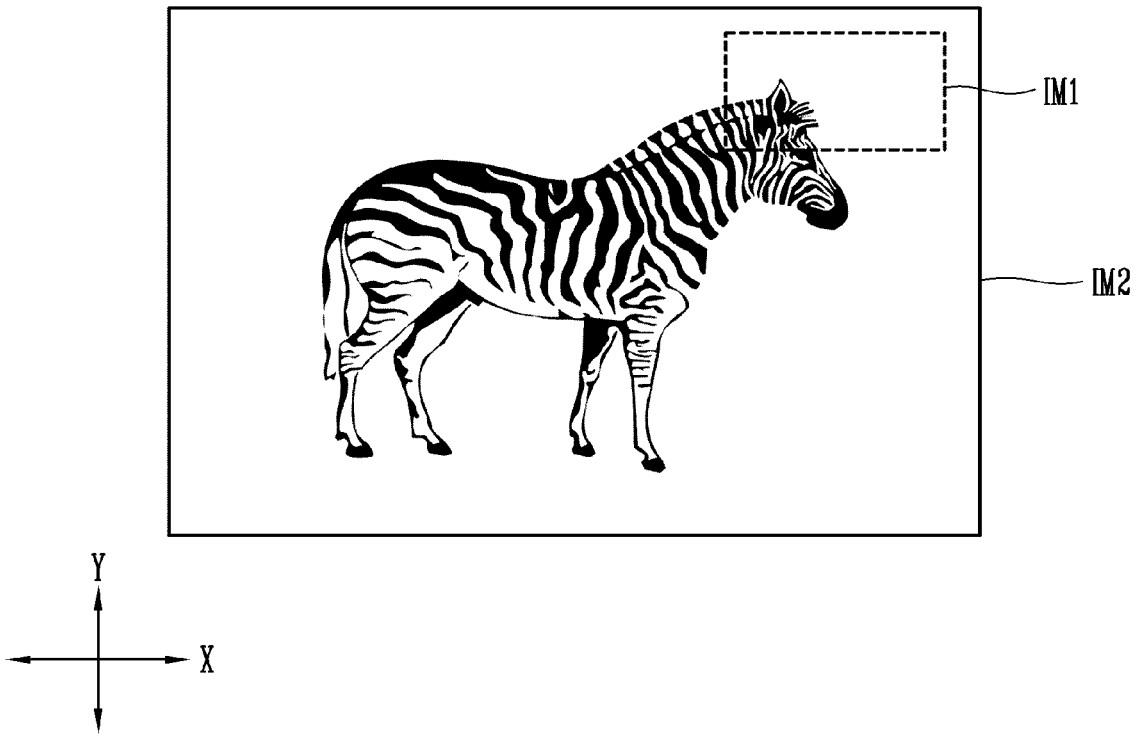
FIG. 8A is a diagram illustrating an example of an image displayed in the display device.
Figure 8B:
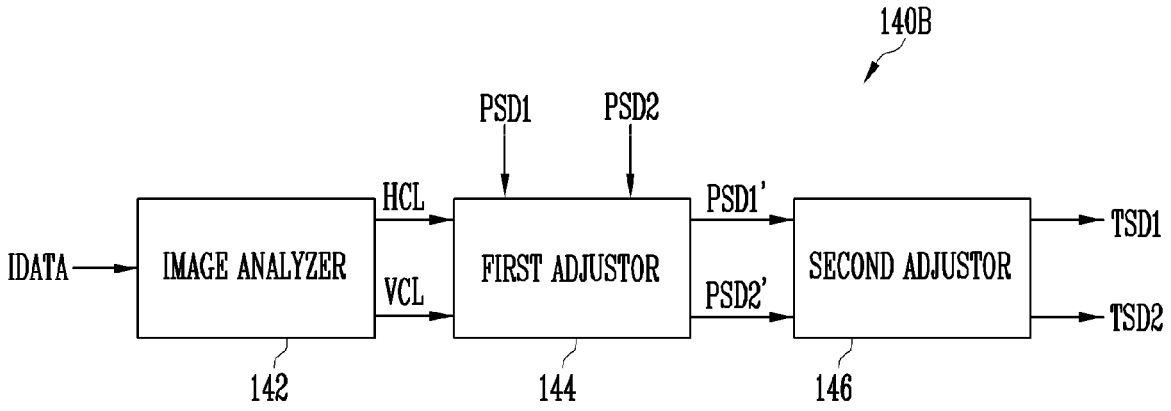
FIG. 8B is a diagram illustrating an example of the shift direction determiner included in the image compensator of FIG. 2.
Figure 8C:
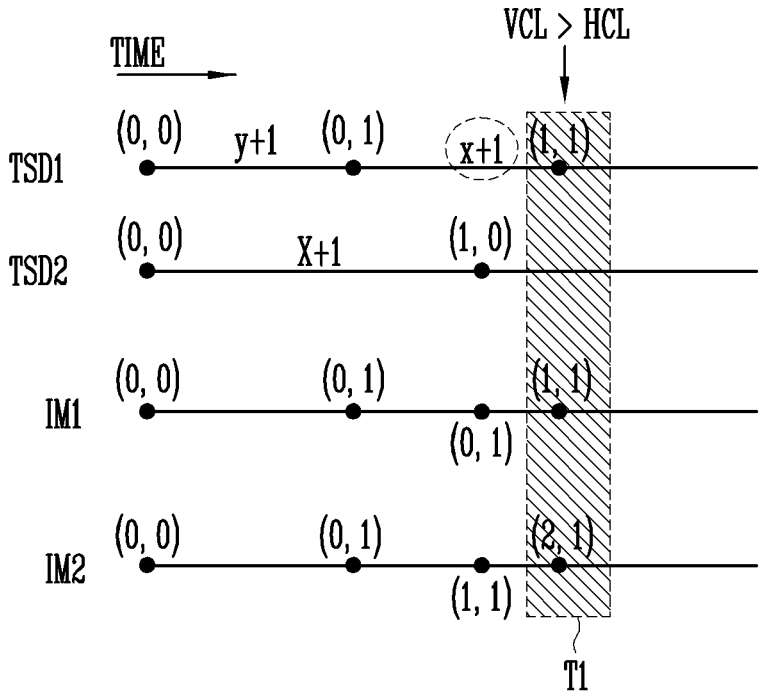
FIGS. 8C and 8D are diagrams illustrating examples of an operation of the shift direction determiner of FIG. 8B.
Figure 8D:
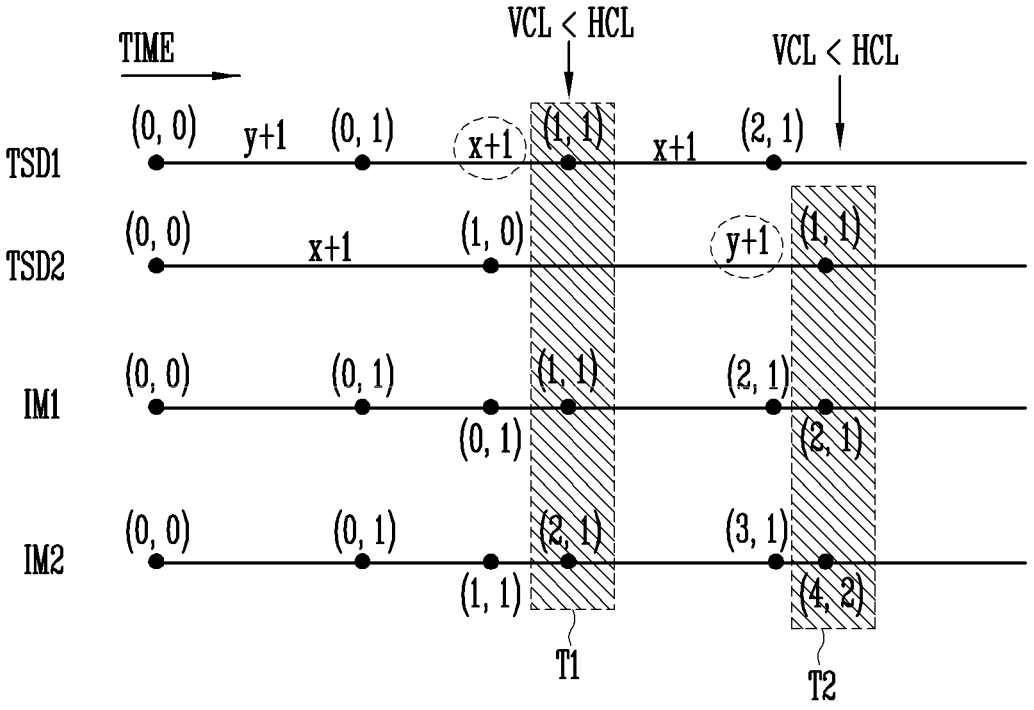

FIG. 8A is a diagram illustrating an example of an image displayed in the display device. FIG. 8B is a diagram illustrating an example of the shift direction determiner included in the image compensator of FIG. 2. FIGS. 8C and 8D are diagrams illustrating examples of an operation of the shift direction determiner of FIG. 8B.

Referring to FIGS. 2 and 8A to 8D, the shift direction determiner 140B may include an image analyzer 142, a first adjustor 144, and a second adjustor 146.

The image analyzer 142 may detect contour lines included in a display image by analyzing input image data DATA. For example, as shown in FIG. 8A, the contour lines may be boundary portions at which grayscales of the image are rapidly changed.

The contour lines may be detected using various types of contour line detection filters or algorithms, which are known in the art. For example, the contour lines may be detected using a Sobel mask method.

The image analyzer 142 may generate a horizontal sum HCL of the contour lines by calculating contour line components in the horizontal direction (i.e., the X-axis direction X), and generate a vertical sum VCL of the contour lines by calculating contour line components in the vertical direction (i.e., the Y-axis direction Y). In an embodiment, the image analyzer 142 may analyze input image data DATA supplied at a corresponding time in the first period and the second period according to the first and second shift scenarios SS1 and SS2.

When the horizontal sum of the contour lines is larger than the vertical sum of the contour lines, that is, when a large number of horizontal contour lines exist in an image, the shift effect of an image shift in the horizontal direction is insignificant. Similarly, when a large number of vertical contour lines exist in an image, the shift effect of an image shift in the vertical direction is insignificant.

The image analyzer 142 and the first adjustor 144 may change the first and second preliminary shift directions PSD1 and PSD2, based on the analysis result of the contour lines.

The first adjustor 144 may adjust the first preliminary shift direction PSD1 and the second preliminary shift direction PSD2, based on a result obtained by comparing the horizontal sum HCL and the vertical sum VCL. In an embodiment, when the vertical sum VCL is larger than the horizontal sum HCL, the first adjustor 144 may adjust the first preliminary shift direction PSD1 and the second preliminary shift direction PSD2 to the horizontal direction (i.e., the X-axis direction X). The first adjustor 144 may provide the second adjustor 144 with the adjusted first preliminary shift direction PSD1' and the adjusted second preliminary shift direction PSD2'.

For example, as shown in FIG. 8C, when the vertical sum VCL is larger than the horizontal sum HCL at a first time T1, the first preliminary shift direction corresponding to the vertical direction may be adjusted to the horizontal direction. That is, the first preliminary shift direction PSD1 is to be moved by 1 pixel in the Y-axis direction Y at the first time T1. However, the first preliminary shift direction PSD1 may be changed such that it is moved by 1 pixel in the X-axis direction X at the first time T1. Therefore, each of first and second images IM1 and IM2 may be further moved by 1 pixel in the X-axis direction X at the first time T1, as compared with a previous frame. That is, when the vertical sum VCL is larger than the horizontal sum HCL, both the target shift directions TSD1 and TSD2 may be adjusted to the X-axis direction X.

In some example embodiments, when the horizontal sum HCL is larger than the vertical sum VCL, the first adjustor 144 may adjust the first preliminary shift direction PSD1 and the second preliminary shift direction PSD2 to the vertical direction (i.e., the Y-axis direction Y).

For example, as shown in FIG. 8D, when the horizontal sum HCL is larger than the vertical sum at a second time T2, the second preliminary shift direction PSD2 corresponding to the horizontal direction may be adjusted to the vertical direction. That is, the second preliminary shift direction PSDw is to be moved by 1 pixel in the X-axis direction X at the second time Tw. However, the second preliminary shift direction PSD2 may be changed such that it is moved by 1 pixel in the Y-axis direction Y at the second time T2. Therefore, each of the first and second images IM1 and IM2 may be further moved by 1 pixel in the Y-axis direction Y at the second time T2, as compared with the previous frame. That is, when the vertical sum VCL is larger than the horizontal sum HCL, both the target shift directions TSD1 and TSD2 may be adjusted to the Y-axis direction Y.

In an embodiment, the second adjustor 146 may compare the adjusted first preliminary shift direction PSD1' and the adjusted second preliminary shift direction PSD2'. When the adjusted first preliminary shift direction PSD1' and the adjusted second preliminary shift direction PSD2' are opposite to each other, the second adjustor 146 may reverse one of the adjusted first preliminary shift direction PSD1' and the adjusted second preliminary shift direction PSD2'. That is, the second adjustor 146 may control the adjusted first preliminary shift direction PSD1' and the adjusted second preliminary shift direction PSD2' such that the adjusted first preliminary shift direction PSD1' and the adjusted second preliminary shift direction PSD2' become the same direction. Accordingly, a shift amount is not cancelled.

The preliminary shift directions adjusted by the second adjustor 146 may be respectively determined as the first target shift direction TSD1 and the second target shift direction TSD2.

As described above, the shift direction is additionally controlled according to the horizontal sum HCL and the vertical sum VCL of the contour lines. Accordingly, the effect of an image shift can maximized, and degradation caused by the effect and occurrence of an afterimage can be minimized.

Figure 9:
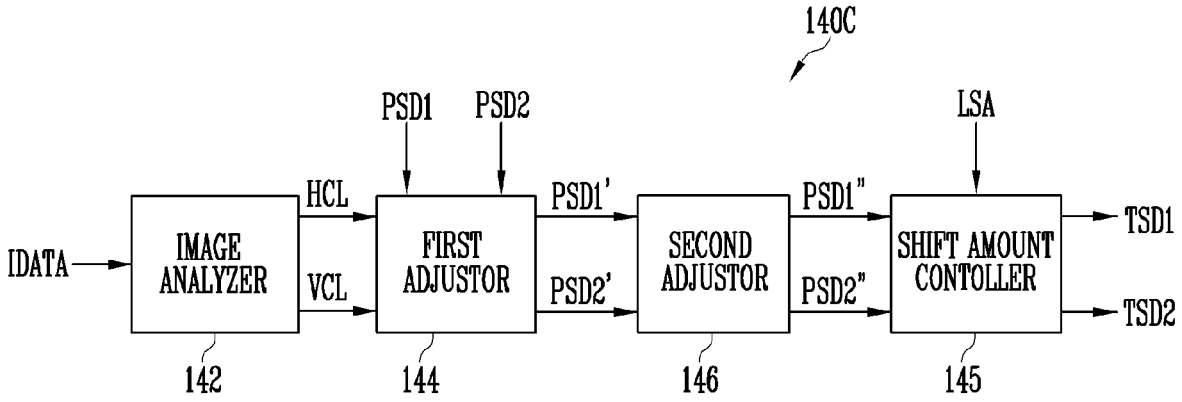
FIG. 9 is a block diagram illustrating an example of the shift direction determiner included in the image compensator of FIG. 2.

FIG. 9 is a block diagram illustrating an example of the shift direction determiner included in the image compensator of FIG. 2.

In FIG. 9, components identical to those described with reference to FIGS. 7A to 8D are designated by like reference numerals, and their overlapping descriptions will be omitted. In addition, the shift direction determiner 140C of FIG. 9 may have a configuration substantially identical or similar to that of the shift direction determiner 140B of FIG. 8B, except a shift amount controller 145.

In some example embodiments, the shift direction determiner 140C may include an image analyzer 142, a first adjustor 144, a second adjustor 146, and a shift amount controller 145.

The image analyzer 142 may calculate a horizontal sum HCL and a vertical sum VCL of contour lines included in a display image by analyzing input image data IDATA.

The first adjustor 144 may adjust the first preliminary shift direction PSD1 and the second preliminary shift direction PSD2, based on a result obtained by comparing the horizontal sum HCL and the vertical sum VCL.

The second adjustor 146 may adjust the adjusted first preliminary shift direction PSD1' and the adjusted second preliminary shift direction PSD2' to the same direction.

The shift amount controller 145 may compare a net shift amount of an original image, which is caused by the adjusted shift directions PSD1" and PSD" output from the second adjustor 146, and the limit shift amount LSA, and correct the shift amount of the original image not to exceed the limit shift amount LSA. For example, the shift amount controller 145 may reverse at least one of the adjusted shift directions PSD1" and PSD2".

An operation of the shift amount controller 145 has been described with reference to FIGS. 7A to 7C, and therefore, its overlapping description will be omitted.

As described above, the image compensator 100 according to some example embodiments of the present disclosure includes the shift direction determiner 140C, so that a shift direction can be adaptively determined for every update time of the shift direction by considering both the relative shift direction relationship and the distribution of contour lines according to the first and second shift scenarios SS1 and SS2 within the limit shift amount LSA. Accordingly, the effect of an image shift can maximized, and degradation caused by the effect and occurrence of an afterimage can be minimized.

Figure 10:
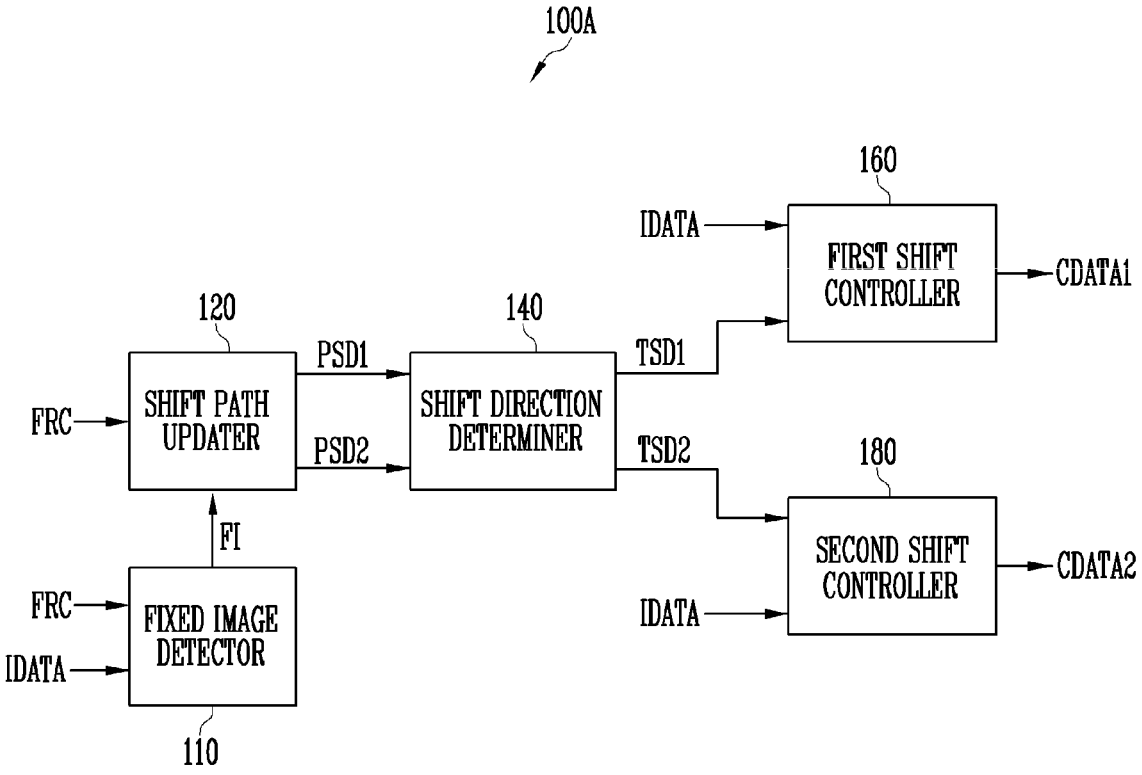
FIG. 10 is a block diagram illustrating an example of the image compensator of FIG. 2.

FIG. 10 is a block diagram illustrating an example of the image compensator of FIG. 2.

In FIG. 10, components identical to those described with reference to FIG. 2 are designated by like reference numerals, and their overlapping descriptions will be omitted. In addition, the image compensator 100A of FIG. 10 may have a configuration substantially identical or similar to the image compensator 100 of FIG. 2, except a fixed image detector 110.

Referring to FIGS. 1, 2, and 10, the image compensator 100A may include a fixed image detector 110, a shift path updater 120, a shift direction determiner 140, a first shift controller 160 and a second shift controller 180.

The fixed image detector 110 may detect a fixed image FI displayed in the display panel 20, based on input image data DATA.

The fixed image may include a logo image of a broadcasting company, a brand, etc. However, this is merely illustrative, and the fixed image may include all images continuously displayed with a high luminance in a specific area of a display screen for a long time.

In an embodiment, the fixed image detector 110 may include an artificial intelligence program that performs machine learning for detecting the fixed image FI. In an example, the fixed image FI may be detected using machine learning based on a convolutional neural network model, etc.

Accordingly, the detection accuracy of the position and shape of the fixed image FI may be considerably improved.

In some example embodiments, the fixed image detector 110 may detect the fixed image FI at a preset time interval, based on a frame count FRC. The fixed image detector 100 may detect the fixed image FI by analyzing consecutive frames (e.g., predetermined frames) at a specific time. The detection of the fixed image FI may be performed using an artificial intelligence program.

In some example embodiments, shift schemes of the first and second shift controllers 160 and 180 may be changed depending on the position of the detected fixed image FI. For example, when, like a logo image, the fixed image FI is located at an outer edge portion of an image, the first and second shift controllers 160 and 180 may shift the image, respectively using a global shift control scheme and a local shift control scheme. Alternatively, when, like a navigation image, the fixed image FI is located at the center of an image, the first and second shift controllers 160 and 180 may shift the image, respectively using a boundary shift scheme and an internal shift scheme.

The shift direction determiner 140 may perform at least one of the functions described with reference to FIGS. 5A to 9.

Figure 11:
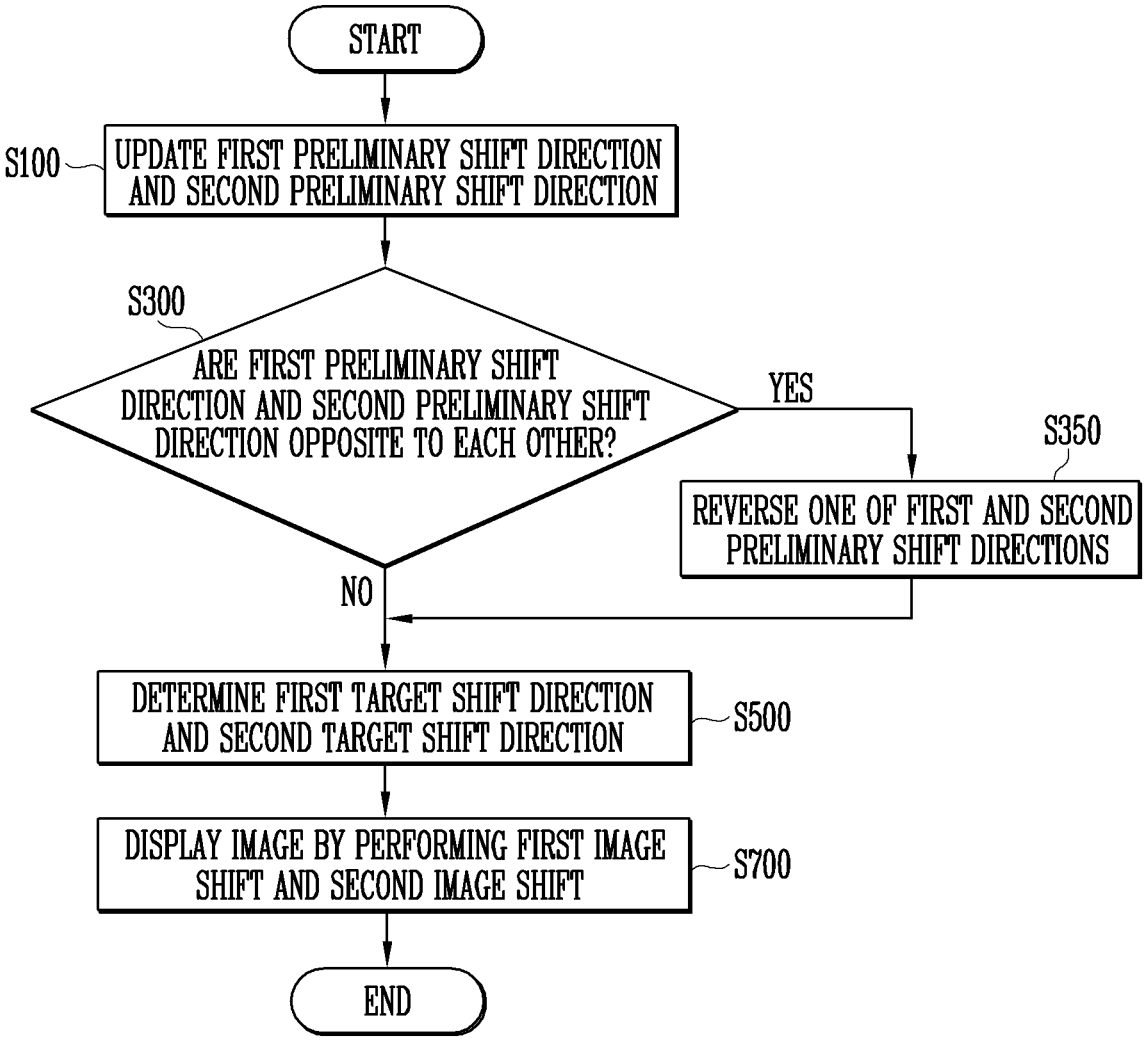
FIG. 11 is a flowchart illustrating a method for driving the display device according to some example embodiments of the present disclosure.

FIG. 11 is a flowchart illustrating a method for driving the display device according to some example embodiments of the present disclosure.

Referring to FIG. 11, in the method, a first preliminary shift direction of a fixed image included in an image may be updated in a preset first period according to a first shift scenario, and a second preliminary shift direction of the fixed image may be updated in a preset second period according to a second shift scenario (S100). The first and second shift scenarios may be corrected based on a result obtained by comparing the first preliminary shift direction and the second preliminary shift direction.

The first preliminary shift direction and the second preliminary shift direction may be compared at a time at which the first preliminary shift direction is updated and a time at which the second preliminary shift direction is updated (S300).

When the first preliminary shift direction and the second preliminary shift direction are opposite to each other, a first target shift direction and a second target shift direction may be determined by reversing one of the first preliminary shift direction and the second preliminary shift direction (S350).

When the first preliminary shift direction and the second preliminary shift direction are not opposite to each other, the first preliminary shift direction and the second preliminary shift direction may be respectively determined as the first target shift direction and the second target shift direction (S500). For example, when the first preliminary shift direction and the second preliminary shift direction are equal to each other or when the first preliminary shift direction and the second preliminary shift direction are perpendicular to each other, the first preliminary shift direction and the second preliminary shift direction may be respectively determined as the first and the second target shift directions.

A first image shift may be performed based on the first target shift direction, and a second image shift may be performed based on the second target shift direction, so that the image is displayed (S700).

As described above, when shift directions of the first and second image shifts according to the first and second shift scenarios conflict with (e.g., opposite to) each other, one preliminary shift direction is reversed, so that the shift amount of the image can be reinforced and/or increased. Thus, the degradation distribution amount of the pixel can be increased, and particularly, the degradation distribution amount of the fixed image can be increased. Accordingly, an image shift effect for reducing an afterimage can be maximized.

Figure 12:
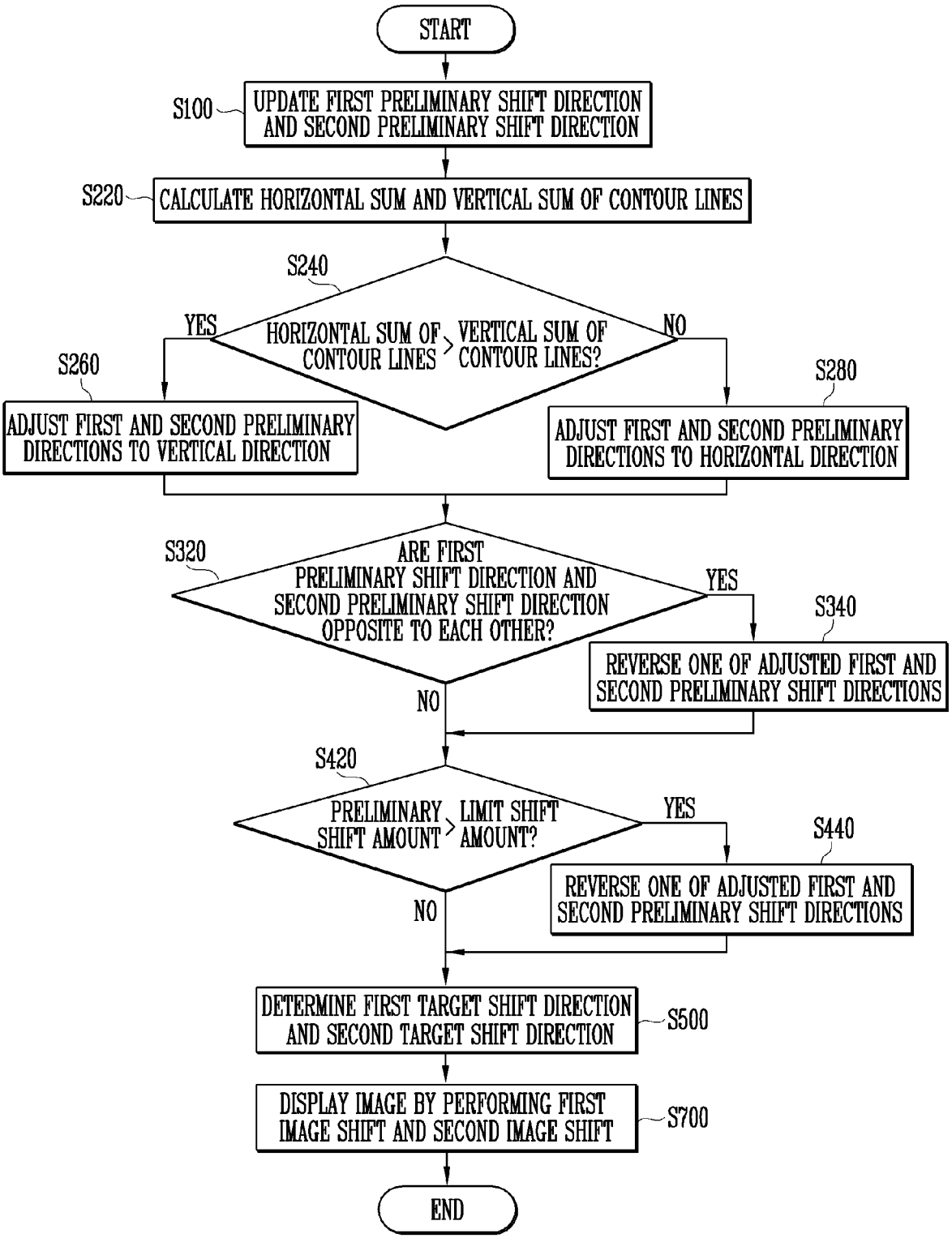
FIG. 12 is a flowchart illustrating an example of the method of FIG. 11.

FIG. 12 is a flowchart illustrating an example of the method of FIG. 11.

Referring to FIGS. 11 and 12, in the method, shift directions may be adjusted such that a portion at a shift effect is cancelled in an image by analyzing input image data.

The determining of the first and second target shift directions (S500) may include calculating a horizontal sum and a vertical sum of contour lines from the input image data (S220), adjusting the first preliminary shift direction and the second preliminary shift direction, based on a result obtained by comparing the horizontal sum and the vertical sum (S240, S260, and S280), and readjusting one of the adjusted first preliminary shift direction and the adjusted second preliminary shift direction, based on a result obtained by comparing the adjusted first preliminary shift direction and the adjusted second preliminary shift direction (S320 and S340).

In some example embodiments, after a horizontal sum and a vertical sum of contour lines are calculated by analyzing the input image data (S220), the horizontal sum and the vertical sum may be compared (S240).

When the horizontal sum is larger than the vertical sum, the first and second preliminary shift directions may be adjusted to the vertical direction (S260). When the vertical sum is larger than the horizontal sum, the first and second preliminary shift directions may be adjusted to the horizontal direction (S280).

The adjusted first preliminary shift direction and the adjusted second preliminary shift direction may be compared (S320). When the adjusted first preliminary shift direction and the adjusted second preliminary shift direction are equal to each other, the adjusted first preliminary shift direction and the adjusted second preliminary shift direction may be respectively determined as the first target shift direction and the second target shift direction. When the adjusted first preliminary shift direction and the adjusted second preliminary shift direction are opposite to each other, one of the adjusted first preliminary shift direction and the adjusted second preliminary shift direction may be reversed (S340).

In some example embodiments, a maximum shift amount may be controlled based on a vector sum of the readjusted first and second preliminary shift directions. For example, a preliminary shift amount determined from the vector sum of the readjusted first and second preliminary shift directions and a preset limit shift amount may be compared (S420).

When the preliminary shift amount exceeds the limit shift amount, one of the readjusted first and second preliminary shift directions may be reversed (S440). When the preliminary shift amount is the limit shift amount or less, the readjusted first and second preliminary shift directions may be respectively determined as the first and second target shift directions (S500).

A first image shift may be performed based on the first target shift direction, and a second image shift may be performed based on the second target shift direction, so that the image is displayed (S700).

As described above, in the method according to the embodiment of the present disclosure, a shift direction can be adaptively determined for every update time of the shift direction by considering both the relative shift direction relationship and the distribution of contour lines according to the first and second shift scenarios within the limit shift amount. Accordingly, the effect of an image shift can maximized, and degradation caused by the effect and occurrence of an afterimage can be minimized.

The present disclosure can be applied to any suitable electronic device including a display device. For example, the present disclosure can be applied to HMD devices, TVs, digital TVs, 3D TVs, PCs, home appliances, notebook computers, tablet computers, mobile phones, smart phones, PDAs, PMPs, digital cameras, music players, portable game consoles, navigation systems, and the like. Also, the present disclosure can be applied to any suitable wearable device such as smart watches.

In the image compensator, the display device including the same, and the method for driving the display device according to some example embodiments of the present disclosure, when shift directions of at least one portion of an image to which first and second image shift schemes are applied conflict with (opposite to) each other, one preliminary shift direction is reversed, so that the shift amount of the image can be reinforced and/or increased. Thus, the degradation distribution amount of the pixel can be increased, and particularly, the degradation distribution amount of the fixed image can be increased. Accordingly, an image shift effect for reducing an afterimage can be maximized or improved.

Further, in the image compensator, the display device including the same, and the method for driving the display device according to the present disclosure, a shift direction can be adaptively determined for every update time of the shift direction by considering both the relative shift direction relationship and the distribution of contour lines according to the first and second shift scenarios within the limit shift amount. Accordingly, the effect of an image shift can maximized or improved, and degradation caused by the effect and occurrence of an afterimage can be minimized or reduced.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Aspects of some example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims and their equivalents.

What is claimed is:

1. An image compensator comprising:

a shift path updater configured to update a first preliminary shift direction of a fixed image included in an image in a preset first period according a first shift scenario, and update a second preliminary shift direction of the fixed image in a preset second period according a second shift scenario;

a shift direction determiner configured to correct the first preliminary shift direction and the second preliminary shift direction respectively to a first target shift direction and a second target shift direction, based on a result obtained by comparing the first preliminary shift direction and the second preliminary shift direction;

a first shift controller configured to perform a first image shift, based on the first target shift direction; and a second shift controller configured to perform a second image shift, based on the second target shift direction.

2. The image compensator of claim 1, wherein the shift direction determiner is configured to reverse one of the first preliminary shift direction and the second preliminary shift direction when the first preliminary shift direction and the second preliminary shift direction are opposite to each other.

3. The image compensator of claim 1, wherein the shift direction determiner is configured to determine the first preliminary shift direction and the second preliminary shift direction respectively as the first target shift direction and the second target shift direction when the first preliminary shift direction and the second preliminary shift direction are not opposite to each other.

4. The image compensator of claim 1, wherein a shift amount of the fixed image is larger than that of another portion of the image when the first target shift direction and the second target shift direction are equal to each other.

5. The image compensator of claim 1, wherein the first shift controller is configured to shift a main area of the image in the first target shift direction.

6. The image compensator of claim 5, wherein the first shift controller is configured to determine an upscaling area and a downscaling area, corresponding to the first target shift direction.

7. The image compensator of claim 5, wherein the second shift controller is configured to shift the fixed image in the second target shift direction.

8. The image compensator of claim 7, wherein the second shift controller is configured to determine an upscaling area and a downscaling area in a preset peripheral area surrounding the fixed image, corresponding to the second target shift direction.

9. The image compensator of claim 7, wherein a shift amount of the fixed image is larger than a shift amount of the main area when the first target shift direction and the second target shift direction are equal to each other.

10. The image compensator of claim 7, wherein a shift amount of the fixed image is two times of a shift amount of the main area when the first target shift direction and the second target shift direction are equal to each other.

11. The image compensator of claim 1, wherein the first shift controller is configured to shift a downscaled image in the first target shift direction by downscaling the whole of the image to be smaller than a screen of a display panel.

12. The image compensator of claim 11, wherein the second shift controller is configured to downscale image data of a portion out of the screen and upscales image data of a black portion of the display panel while shifting the whole of the image in the second target shift direction.

13. The image compensator of claim 1, wherein the shift direction determiner includes:

a shift amount controller configured to reverse at least one of the first preliminary shift direction and the second preliminary shift direction by comparing a limit shift amount from an original image, which is set with respect to shift directions, and a preliminary shift amount determined by a vector sum of the first preliminary shift direction and the second preliminary shift direction.

14. The image compensator of claim 13, wherein the shift amount controller is configured to reverse a preliminary shift direction equal to a shift direction of the limit shift amount when the preliminary shift amount exceeds the limit shift amount.

15. The image compensator of claim 1, wherein the shift direction determiner includes:

an image analyzer configured to detect contour lines included in the image by analyzing input image data, and to analyze a horizontal sum and a vertical sum of the contour lines;

a first adjustor configured to adjust the first preliminary shift direction and the second preliminary shift direction, based on a result obtained by comparing the horizontal sum and the vertical sum; and a second adjustor configured to compare the adjusted first preliminary shift direction and the adjusted second preliminary shift direction, and to reverse one of the adjusted first preliminary shift direction and the adjusted second preliminary shift direction when the adjusted first preliminary shift direction and the adjusted second preliminary shift direction are opposite to each other.

16. The image compensator of claim 15, wherein the first adjustor is configured to adjust the first preliminary shift direction and the second preliminary shift direction to a vertical direction when the horizontal sum is larger than the vertical sum.

17. The image compensator of claim 15, wherein the first adjustor adjusts the first preliminary shift direction and the second preliminary shift direction to a horizontal direction when the vertical sum is larger than the horizontal sum.

18. The image compensator of claim 15, wherein the shift direction determiner further includes:

a shift amount controller configured to reverse at least one of the adjusted first preliminary shift direction and the adjusted second preliminary shift direction by comparing a limit shift amount set with respect to shift directions and a preliminary shift amount determined by a combination of preliminary shift directions output from the second adjustor.

19. The image compensator of claim 1, further comprising:

a fixed image detector configured to detect the fixed image, based on input image data.

20. The image compensator of claim 19, wherein the fixed image detector includes:

an artificial intelligence program that performs machine learning for detecting the fixed image.

21. A method for driving a display device, the method comprising:

updating a first preliminary shift direction of a fixed image included in an image in a preset first period according a first shift scenario, and updating a second preliminary shift direction of the fixed image in a preset second period according a second shift scenario;

in response to the first preliminary shift direction and the second preliminary shift direction being opposite to each other, determining a first target shift direction and a second target shift direction by reversing one of the first preliminary shift direction and the second preliminary shift direction;

performing a first image shift, based on the first target shift direction; and performing a second image shift, based on the second target shift direction.

22. The method of claim 21, wherein the determining of the first and second target shift directions further includes:

in response to the first preliminary shift direction and the second preliminary shift direction not being opposite to each other, determining the first preliminary shift direction and the second preliminary shift direction respectively as the first target shift direction and the second target shift direction.

23. The method of claim 21, wherein the determining of the first target shift direction and the second target shift direction includes:

calculating a horizontal sum and a vertical sum of contour lines from input image data;

adjusting the first preliminary shift direction and the second preliminary shift direction, based on a result obtained by comparing the horizontal sum and the vertical sum; and readjusting one of the adjusted first preliminary shift direction and the adjusted second preliminary shift direction, based on a result obtained by comparing the adjusted first preliminary shift direction and the adjusted second preliminary shift direction.

24. The method of claim 23, wherein the adjusting of the first preliminary shift direction and the second preliminary shift direction includes:

in response to the horizontal sum being larger than the vertical sum, adjusting the first and second preliminary shift directions to a vertical direction; and in response to the vertical sum being larger than the horizontal sum, adjusting the first and second preliminary shift directions to a horizontal direction.

25. The method of claim 23, wherein the readjusting of the one of the adjusted first preliminary shift direction and the adjusted second preliminary shift direction includes:

in response to the adjusted first preliminary shift direction and the adjusted second preliminary shift direction being equal to each other, determining the adjusted first preliminary shift direction and the adjusted second preliminary shift direction respectively as the first target shift direction and the second target shift direction; and in response to the adjusted first preliminary shift direction and the adjusted second preliminary shift direction being opposite to each other, reversing one of the adjusted first preliminary shift direction and the adjusted second preliminary shift direction.

26. The method of claim 23, wherein the determining of the first target shift direction and the second target shift direction further includes:

comparing a preliminary shift amount determined by a vector sum of the readjusted first and second preliminary shift directions and a preset limit shift amount;

in response to the preliminary shift amount exceeding the limit shift amount, reversing one of the readjusted first and second preliminary shift directions; and in response to the preliminary shift amount being the limit shift amount or less, determining the readjusted first and second preliminary shift directions respectively as the first and second target shift directions.

* * * * *